US005448780A

United States Patent [19]

Gath

[11] Patent Number: 5,448,780

[45] Date of Patent: Sep. 12, 1995

[54] SAFETY HELMET

[76] Inventor: Ricky J. Gath, Lot 66, Wilderness Road, Margaret River 6285, Western Australia, Australia

[21] Appl. No.: 100,599

[22] Filed: Jul. 30, 1993

Related U.S. Application Data

[63] Continuation-in-part of Ser. No. 764,100, Sep. 23, 1991, abandoned, which is a continuation of Ser. No. 425,216, Oct. 10, 1989, abandoned.

[30] Foreign Application Priority Data

| | | | |
|---|---|---|---|
| Mar. 5, 1987 | [AU] | Australia | PI0676 |
| Jun. 9, 1987 | [AU] | Australia | PI2364 |
| Dec. 16, 1987 | [AU] | Australia | PI5946 |

[51] Int. Cl.[6] ..... A42B 1/08

[52] U.S. Cl. ..... 2/424; 2/411; 2/414; 2/422; 2/425

[58] Field of Search ..... 2/9, 410, 411, 416, 2/417, 418, 419, 420, 421, 424, 425, 438, 414, 422

[56] References Cited

U.S. PATENT DOCUMENTS

| | | | |
|---|---|---|---|
| 2,769,176 | 11/1956 | Grancsay et al. | 2/421 |
| 2,898,596 | 8/1959 | Keen | 2/421 |
| 3,223,086 | 12/1965 | Denton | 2/410 |
| 3,239,843 | 3/1966 | Lobelle | 2/6 |
| 3,400,407 | 9/1968 | Aileo | 2/6 |
| 3,513,481 | 5/1970 | Nickerson | 2/418 |
| 3,600,713 | 8/1971 | Holt | 2/3 |
| 3,721,994 | 3/1973 | DeSimone et al. | 2/6 |
| 3,729,744 | 5/1973 | Rappleyea | 2/420 |
| 4,021,878 | 5/1977 | Peillex | 2/438 |
| 4,117,554 | 10/1978 | Palumbo | 2/418 |
| 4,130,803 | 12/1978 | Thompson | 325/361 |
| 4,400,591 | 8/1983 | Jennings et al. | 2/424 |
| 4,404,690 | 9/1983 | Farquharson | 2/420 |
| 4,463,456 | 8/1984 | Hanson | 2/416 |
| 4,475,248 | 10/1984 | L'Abbe et al. | 2/2.5 |
| 4,571,741 | 2/1986 | Guillaumot | 2/8 |
| 4,612,672 | 9/1986 | Schrack | 2/411 |
| 4,633,532 | 1/1987 | Yagasaki | 2/424 |
| 5,044,016 | 9/1991 | Coombs | 2/416 |

FOREIGN PATENT DOCUMENTS

| | | | |
|---|---|---|---|
| 418643 | 3/1971 | Australia . | |
| 516898 | 6/1981 | Australia . | |
| 15796 | 9/1980 | European Pat. Off. . | |
| 2532528 | 3/1984 | France | 2/424 |
| 2427906 | 1/1975 | Germany | 2/438 |
| 2645262 | 4/1978 | Germany | 2/438 |
| 208442 | 1/1940 | Switzerland | 2/9 |
| 1287746 | 9/1972 | United Kingdom | 2/438 |

OTHER PUBLICATIONS

AU, B, 43776/79 (516898) (Canadian Patents and Development Limited) 16 Aug. 1979 (16.08.79).

AU, B, 60758/69 (418643) (Sierra Engineering Co.) 18 Mar. 1971 (18.03.71).

*Primary Examiner*—Clifford D. Crowder

*Assistant Examiner*—Michael A. Neas

*Attorney, Agent, or Firm*—Ralph F. Crandell; Holland & Hart

[57] ABSTRACT

A high performance sport safety helmet. The helmet is formed by an outer shell adapted for fitting upon a wearer's head, with a frontal periphery defining a centrally arched portion forming a front opening exposing the face and a major portion of the forehead of the wearer. The shell further has a base periphery defining an arcuate base opening for receiving the wearer's neck. A flexible resilient expandable front band is secured to and extends across the front opening of the shell with a substantial portion of the band lying below the centrally arched portion. The band snugly engages and substantially completely covers the forehead of the wearer. An articulated shell liner is secured to and covers the inner surface of the shell. The liner is partially separable and non-detachable from the shell. A visor is pivotally secured to the shell and nestable between the shell and the shell liner for selectively shielding the front opening of the shell.

38 Claims, 18 Drawing Sheets

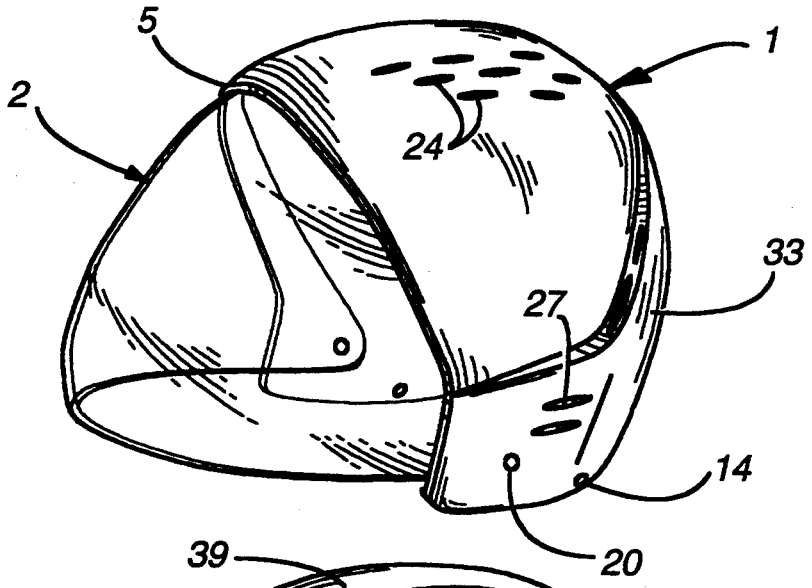
Fig. 5
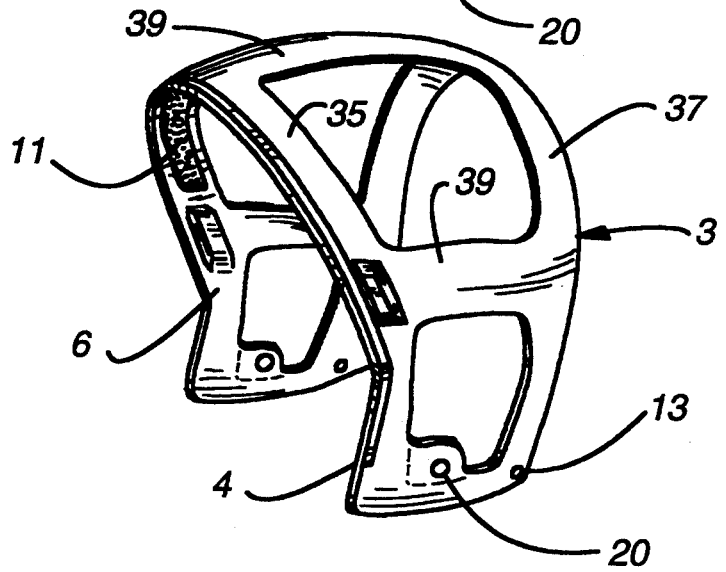
Fig. 6
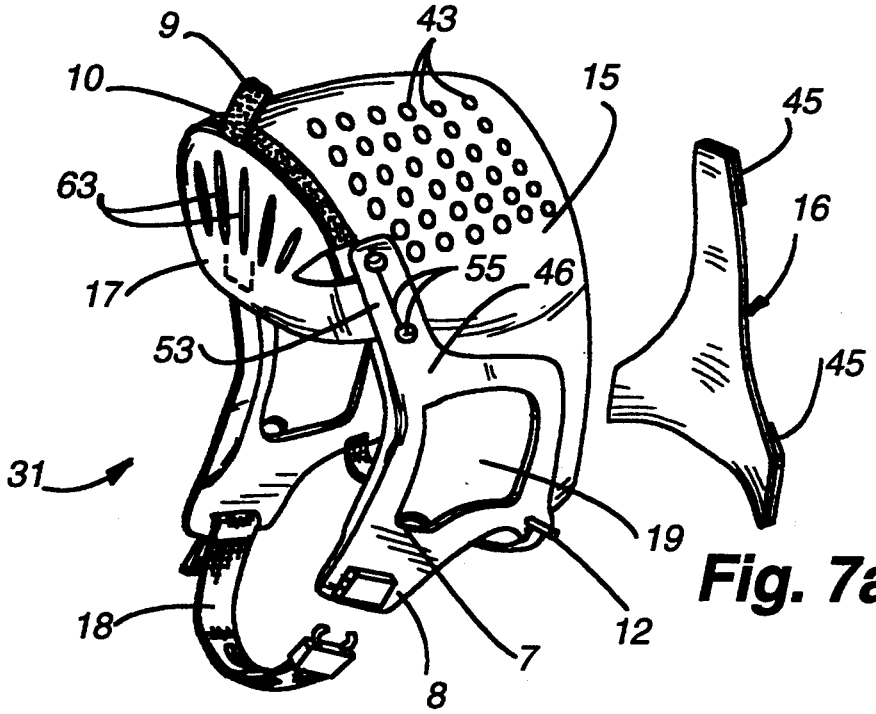
Fig. 7
Fig. 7a

SAFETY HELMET

CROSS-REFERENCE TO RELATED APPLICATIONS

This application is a continuation-in-part of application Ser. No. 07/764,100, filed Sep. 23, 1991, now abandoned, which application was a continuation of application Ser. No. 07/425,216, filed Oct. 10, 1989, on international application Ser. No. PCT/AU88/00062, filed Mar. 8, 1988, which designates the U.S., which U.S. application Ser. No. 07/425,216 is now abandoned.

BACKGROUND OF THE INVENTION

1. Field of the Invention

This invention relates to a high performance sport safety helmet and particularly, although not exclusively, to a high performance sport safety helmet which has utility in water sports.

2. Description of the Prior Art

With the increasing emphasis on professionalism in sport and the increased interest in sport generally both from a health point of view and an entertainment point of view, participants are becoming more and more conscious of the need to take appropriate measures to reduce the likelihood of injury which can occur from participating in their sport. This is not only to increase the enjoyment that can be obtained from actually performing the sport, but also as a means of maximizing their participation in the sport particularly if that participation constitutes a means of income to the participant or affiliates prospering from the sport.

The use of safety helmets to prevent or mitigate the likelihood of head injury was adopted by participants in many sports involving the possibility of physical contact with the surrounding environment, quite early in the piece, due to the quite major injuries that can be sustained to the head region from such contact. The first forms of these helmets were quite bulky where the major consideration was protection to the head region, rather than considerations of the impact that the helmet would have on high level performance. For example, safety helmets became compulsory apparel in car racing, motorbike racing, speed boat racing and the like quite some time ago, where impairment of physical movement did not impact that much upon high level performance.

In sports where there was a greater need for physical movement in order to optimize performance, the introduction of safety helmets, has been very slow. In these sports, such as football, cricket, surfing, sailboarding, etc., participants have preferred to take a risk by not wearing bulky protective head gear so that this would not impede their performance at all. Consequently, in these sports, there has always been the occasional severe head injury as a result of competitors not using protective head gear. In some instances, this has prompted the regulatory body of the sport to introduce laws to insist upon the wearing of protective head gear so as to minimize the likelihood of head injury occurring. This has been reasonably successful in sports such as grid iron, cycling and a variety of winter sports.

Although such rules are capable of being enforced when the sport is played at a professional level, there has been great difficulty in insisting upon compulsory wearing of head gear at the amateur level, and indeed in other sports where professionalism is still evolving.

One of the major problems confronted with encouraging people to adopt protective head gear is that the design of the head gear in most instances has not been specifically customized for the particular sport involved, and in most cases, the actual helmet design is based upon previous specification requirements of another sport where the helmet has an established market, making it viable for the manufacturer to still produce the helmet.

As previously discussed, where the major market for safety helmets over the years has been forged in those sports which have relied upon the use of helmets primarily for protection purposes and where the requirements for physical movement are not that great, these helmets have traditionally been bulky. Consequently, there is high participant resistance to adopting helmets which are too bulky and consequently can impede significantly the performance of the participant in the particular sport, particularly where the nature of the possible impact that would occur in the head region is not of the same magnitude as that associated with sports such as motor car racing and the like.

Accordingly, it is an object of the present invention to provide a simple but effective design of helmet which provides a degree of protection from impact or other impingement of the head, of either an active or passive nature, but which has minimal effect upon the physical mobility of the wearer so enabling the wearer to maintain a high level of performance while simultaneously providing protection to the head of the wearer.

As a result of the increasing competitiveness of certain water sports such as sailboarding, surfing and the like, there is a greater need for facial protection from impact with not only the water but also with the apparatus used in the sport. For example, sailboarders now are performing radical forward loops and the like and in many cases are receiving facial injuries from collisions with the sailboard. Similarly, surfers have been encountering similar problems for many years with the recoil of the surfboard as a result of the retention of the surfboard by a leg rope attached to the legs of the surfer.

Accordingly, it is a further and preferred, although not exclusive object of the invention to provide an effective design of helmet which is particularly suited to water sports.

With respect to the effects of passive impingement of the head, such as exposure to ultraviolet radiation from the sun, the present invention also has significant utility. Moreover, most recreational activities and sports, in particular water sports, are performed outdoors where the participants are exposed to ultraviolet radiation from the sun. Participants in recreational activities and sports such as cycling, hang gliding, skate board riding and especially water sports activities such as sailboarding, surfing, yachting, wave skiing, water skiing, canoeing, jet skiing, snow skiing and the like, are all exposed to direct sunlight as well as reflective sunlight from their surrounding environment. Although it has previously been known to use head gear provided with small peak visors in these activities and sports in order to provide eye and facial protection from the sun, such devices only protect a relatively small portion of the face and stop only minimal glare to the eyes. Significantly, they do not provide any protection against direct impact, and do not provide any protection at all to the ears of a wearer.

In the case of water sports, a participant subjected to the reflective glare of sunlight from the water would find little protection by the provision of the peak visor since the direction of the reflective sunlight is from below the height of the peak visor.

Accordingly, it is a preferred, although not exclusive object of the invention to provide protection from the effects of ultraviolet radiation to persons engaged in recreational or sporting activities requiring such protection, while providing for impact protection and protection to the ears of a wearer of the helmet.

Additionally, the provision of peak visors on head gear can also create difficulties for wearers of such head gear in water sports, whereby the peak visor may interfere with vision and provide a surface which may impede the flow of water or air past the face of the user in activities where such an impediment is undesirable. For example, a surfer pushing through a wave or falling into the water could have his or her head gear removed by the force of the water against the peak visor or at least be subjected to an uncomfortable pulling force against the neck of the wearer if such head gear included a chin strap.

It is a further preferred although not exclusive object of the invention to provide a helmet which has particular, although not exclusive utility for persons engaged in water sports or recreational activities where there is a need to maintain a clear field of vision and be aerodynamically and hydrodynamically streamlined so as not to impede the passage of a wearer.

In addition, people involved in water sports in cold conditions, for example, sailboard riders, surfboard riders and the like, also need ear protection from the cold wind and water. Overexposure of the ear to cold wind and water causes exostosis, i.e. bone growth in the ear canal. Head gear such as that disclosed in U.S. Pat. No. 4,612,672 which includes a rubber peak hood and covers for the ears, have a tendency to trap water in the ears but do not provide adequate draining of water therefrom. In order to prevent or mitigate the effects of exostosis, it is necessary to quickly release water from the ear which has been trapped therein, continuously. In the device disclosed in U.S. Pat. No. 4,612,672, the release of water from the ear is not performed efficiently since the drainage hole must-be disposed lower than the level of trapped water within the ear canal before drainage of this trapped water would occur. Thus, it would be necessary to tilt the head of the wearer from one side to the other regularly to alter the disposition of the drain relative to the ear canal to achieve adequate drainage.

It is another preferred although not exclusive object to provide protection from the long term effects of exposure to salt water and the like, so as to obviate or at least mitigate the occurrence of exostosis with participants in water sports or the like.

Another deficiency with previously designed helmets such as those disclosed in Australian Patent No. 418643, U.S. Pat. Nos. 3,400,407 and 3,721,994 and European Patent No. EP 15-796 is that inadequate ventilation is provided to the head of the wearer and thus the prolonged wearing of such helmets causes much discomfort to the wearer where the wearer is engaged in an activity causing perspiration or heating of the head area.

Accordingly, it is another preferred although not exclusive object of the present invention to provide a helmet which can also adequately ventilate the head of a wearer.

Finally, a deficiency with previous designs of helmets as disclosed in the previously cited patent specifications is the inability of those helmets provided with visors to easily clean the visor from a build up in water vapor or droplets on the visor caused by either the breathing of the wearer or from the environment. Helmet designs disclosed in Australian Patent No. 516898 and U.S. Pat. No. 3,239,843 provide complex means for cleaning the visor by means of a heated airflow across the visor face, which is not practical for use in recreational or sporting activities. Additionally, such means proves ineffective in removing solid particles which have become inadvertently deposited on the surface of the visor.

It is also a preferred but not exclusive object to obviate or at least mitigate the disadvantages and inefficiencies of previous designs of helmets having visors of the type described above.

SUMMARY OF THE INVENTION

In accordance with one aspect of the present invention, there is provided a high performance sport safety helmet comprising, in combination, a shell adapted for fitting upon a wearer's head and having a frontal periphery defining a centrally arched portion forming an open front exposing the face and a major portion of the forehead of the wearer, a flexible resilient expandable front band extending across the front of said shell with a substantial portion of said band lying below said centrally arched portion and adapted for snugly engaging and substantially completely covering the forehead of the wearer, and means securing said band to said shell, whereby the head and forehead of the wearer are covered and protected against direct impact by a foreign object.

Preferably, the securing means for mounting said band in said shell is adjustable relative to the forehead of the wearer.

Preferably, the helmet includes means defining a series of ventilation holes in said band.

Preferably, the helmet includes an inner shell liner comprising leading and rear peripheral portions disposed along the inner periphery of the helmet, a central apical portion disposed centrally of the inner surface of the helmet between said leading and rear peripheral portions, and front and rear parietal portions disposed between said leading and rear peripheral portions and said central apical portion over the remaining inner surface of the helmet, so that said shell liner completely covers the cranium of a wearer, and wherein some of the portions of the liner are discrete from other portions of the liner to enable access to the inner surface of the helmet for cleaning purposes.

Preferably, the bottom peripheral portions of said inner shell liner are contoured to facilitate the drawing of fluid from with the helmet.

Preferably, the leading peripheral portion comprises a lobe portion at each side of the helmet formed with a central opening for accommodating the ears of wearer, the bottom of the lobe portion having a drain connecting to said central opening for communicating with the base of the outer ear canal of a wearer of the helmet so as to be capable of draining fluid from said ear canal and said central opening.

Preferably, the centrally arched portion is formed with a high cut over the forehead portion of said wearer and is rearwardly swept at the sides of the helmet to enable complete peripheral vision.

In accordance with another aspect of the present invention, there is provided a high performance sport safety helmet comprising: a substantially rigid shell for fitting upon a wearer's head and having an open front to expose the face of the wearer; a single, substantially lune-shaped visor pivotally mounted to said shell and moveable between a closed position an open position, and any intermediate position therebetween, said visor defining a leading edge and being slightly sculptured inwardly of the general locus of curvature thereof proximate to said leading edge so that in said open position said leading edge presents a closed face mitigating drag through air or water impinging on the front of said helmet, and means for retaining said visor at any intermediate position between said open and said closed positions, (i) in said closed position said visor substantially closes said open front maintaining the general curvature of said shell to substantially cover the face of said wearer providing protection from impact and shading from the sun without impairing vision, and said leading edge of said visor is generally aligned with the bottom of the nose of the wearer, (ii) in said open position the major portion of said visor is disposed within said shell and conforms to the contour of said shell to expose the face of said wearer without interfering with the fitting of said shell upon said wearer's head and the minor exposed portion of said visor comprising said leading edge is contiguous to said shell while maintaining the general curvature of said shell, and (iii) the curvature of said visor adjacent said leading edge provides minimal disruption to the line of sight of said wearer so that said visor can be used in an intermediate position.

Preferably, the retaining means comprises a wiper fixedly mounted to the shell having a blade to frictionally engage the face of the visor, whereby during movement of the visor between the open position and the closed position the blade wipes across the face of the visor to clean the same while preventing the retention of foreign particles which otherwise would scratch said face.

Preferably, the visor is slightly sculptured inwardly of the general locus of curvature thereof proximate to the leading edge so that in the open position, the leading edge presents a closed face mitigating drag through air or through water impinging the front of said helmet.

Preferably, the helmet includes resilient head retention means comprising a top cover for covering the parietal and temporal portion of the wearer's cranium, a back support for covering the occipital portion of the wearer's cranium, and a pair of side covers for covering the ears and the temporal portion of the wearer's cranium, the side covers are each provided with a pouch to accommodate the ears of the wearer, the pouch having a drain disposed in the region of the pouch communicating with the base of the outer ear canal of the wearer so as to be capable of draining liquid from the ear canal and the region.

Preferably, the front band is fitted to the shell to provide for adjustment relative to the head of the wearer.

In accordance with a further aspect of the present invention, there is provided a high performance sport safety helmet comprising, in combination, a shell adapted for fitting upon a wearer's head and having a frontal periphery defining a centrally arched portion forming an open front exposing the face and a major portion of the forehead of the wearer, a flexible resilient hood for covering the wearer's head, means for releasably securing said hood within said shell, said hood including a flexible resilient front band extending across said centrally arched portion of said shell below said centrally arched portion and adapted for engaging and covering the forehead of the wearer, and means releasably securing said band to said shell, whereby the head and forehead of the wearer are covered and protected against direct impact by a foreign object.

In accordance with another aspect of the present invention, there is provided a high performance sport safety helmet comprising, in combination, a shell adapted for fitting upon a wearer's head and having a frontal periphery defining a centrally arched portion forming a generally vertical open front fully exposing the face and a major portion of the forehead of the wearer, a flexible resilient expandable front band extending across the upper open front of said shell with a substantial portion of said band lying below said centrally arched portion and adapted for snugly engaging and substantially covering the forehead of the wearer, and means securing said band to said shell, whereby the helmet can be readily and easily placed on the head of the wearer and the head and forehead of the wearer are covered and protected against direct impact by a foreign object.

In accordance with an even further aspect of the present invention, there is provided a high performance sport safety helmet comprising, in combination, a shell adapted for fitting upon a wearer's head and having a frontal periphery defining a centrally arched portion forming a generally vertical open front exposing the face and a major portion of the forehead of the wearer, a flexible resilient hood for covering the wearer's head, means for releasably securing said hood within said shell, said hood including a flexible resilient expandable front band extending across the upper open front of said centrally arched portion of said shell substantially completely below said centrally arched portion and adapted for snugly engaging and covering the forehead of the wearer, and means securing said band to said shell, whereby the helmet can be readily and easily placed on the head of the wearer and the head and forehead of the wearer are covered and protected against direct impact by a foreign object.

DESCRIPTION OF DRAWINGS

The invention will be better understood in the light of the following description of several specific embodiments of the invention. The description is made with reference to the following drawings wherein:

FIG. 5 is a perspective view of the outer shell of the helmet shown in FIG. 1;

FIG. 6 is a perspective view of the inner frame of the helmet shown in FIG. 1;

FIG. 7 is a perspective view of the head retainer of the helmet shown in FIG. 1;

FIG. 7*a* is a perspective view of the back support of the helmet shown in FIG. 1;

FIGS. 16*a*, 16*b* and 16*c* are perspective views of the helmet in accordance with the second embodiment showing the progressive positioning of the visor in the open position in FIG. 16*a*, the intermediate position in FIG. 16*b* and the closed position in FIG. 16*c*;

DESCRIPTION OF THE VARIOUS EMBODIMENTS

Figure 1:
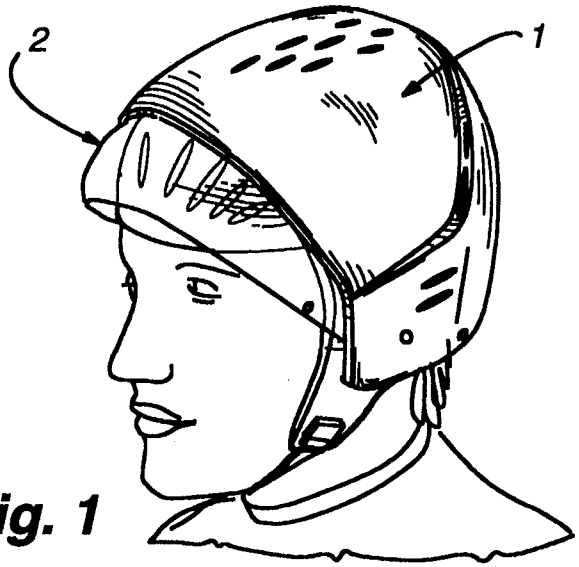
FIG. 1 is a side view of the helmet in accordance with the first embodiment, positioned upon the head of a wearer with the visor in the open position.

The first embodiment is directed towards a high performance sport safety helmet which is particularly suited to use in water sports and as shown in the drawings, generally comprises an outer shell 1, a visor 2, an inner frame 3 and a head retention means 31.

Figure 2:
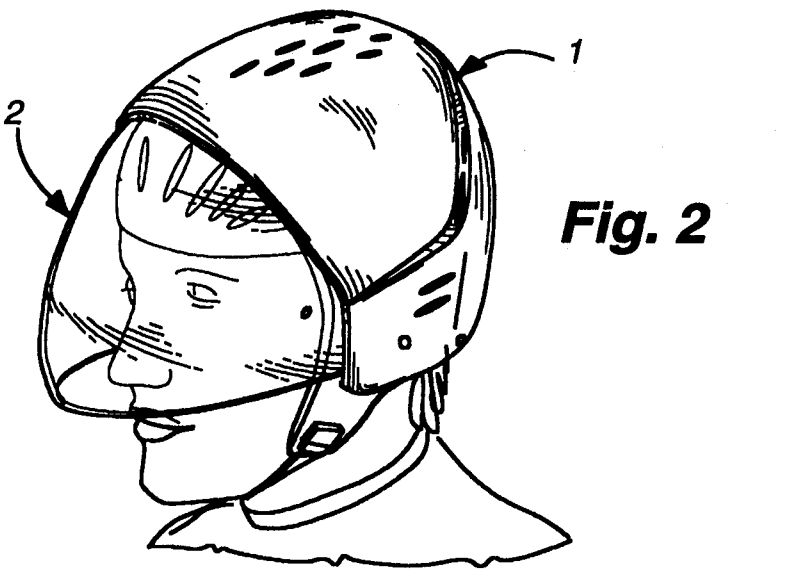
FIG. 2 is a similar view to FIG. 1 with the visor in the closed position.
Figure 3:
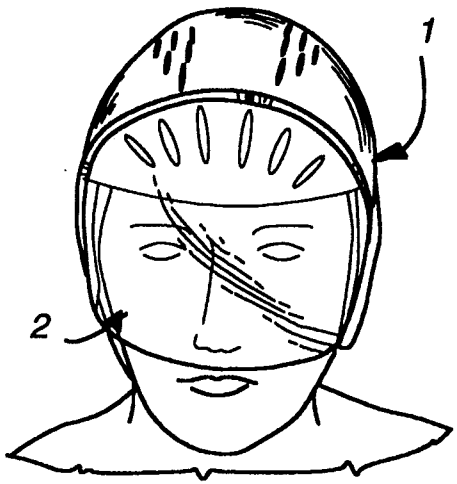
FIG. 3 is a front view of FIG. 2.

The shell 1 is preferably molded from polycarbonate plastic to provide sufficient rigidity to protect the head of a wearer from an impact with an object. The shell is provided with an open front which is cut back over the forehead area of the wearer to expose the face of the wearer as shown in FIGS. 1, 2, and 3 enabling complete peripheral vision, and a rear arch over the neck area of the wearer to allow for rearward movement of the head of the wearer relative to the shoulders. The shell is otherwise shaped to cover the cranium and ears of the wearer. The outer surface of the shell 1 is contoured to the shape of the head of the wearer to provide aerodynamic efficiency and has a lune shaped ridge formation 33 extending from one side of the helmet to the other. A series of apertures 26 are disposed at regularly spaced intervals along the front face of the ridge to provide an entry for fluid flow along the surface of the helmet into the confines of the shell for ventilation purposes. A plurality of upper apertures 24 are provided along the upper surface of the shell away from the ridge 33 to direct fluid flow into the shell for ventilation. In addition, a plurality of lateral apertures 27 are provided at each side of the shell for the same effect and also to facilitate hearing of the wearer. The shell is also provided with a plurality of latitudinally extending reinforcing ribs 25 along the upper surface adjacent to the upper apertures 24 for strengthening purposes.

The visor 2 is preferably formed of tinted polycarbonate plastic for resisting ultraviolet radiation and is generally lune shaped. The visor is pivotally mounted to the shell by means of a pin 28 extending through an aperture 20 and is movable between an open position shown at FIG. 1 of the drawings and a closed position as shown at FIG. 2. The visor is shaped to be generally contiguous with the shape of the shell so as to substantially cover the face of the wearer. The surface of the visor is curved to conform with the curvature of the shell so that the visor may be retracted or moved into the closed position so that the major portion of the visor is disposed within the confines of the shell without interfering with the fitting of the shell upon the wearer's head and the minor portion of the visor comprising the leading edge 2*b* of the visor is exposed contiguous to the shell and still maintains the general curvature of the shell for aerodynamic and hydrodynamic streamlining while enabling complete peripheral vision.

The visor 2 is particularly sized so that the leading edge 2*b* is generally aligned with the bottom of the nose of the wearer and spaced therefrom when disposed in the fully closed position, as shown in FIG. 2.

Figure 8:
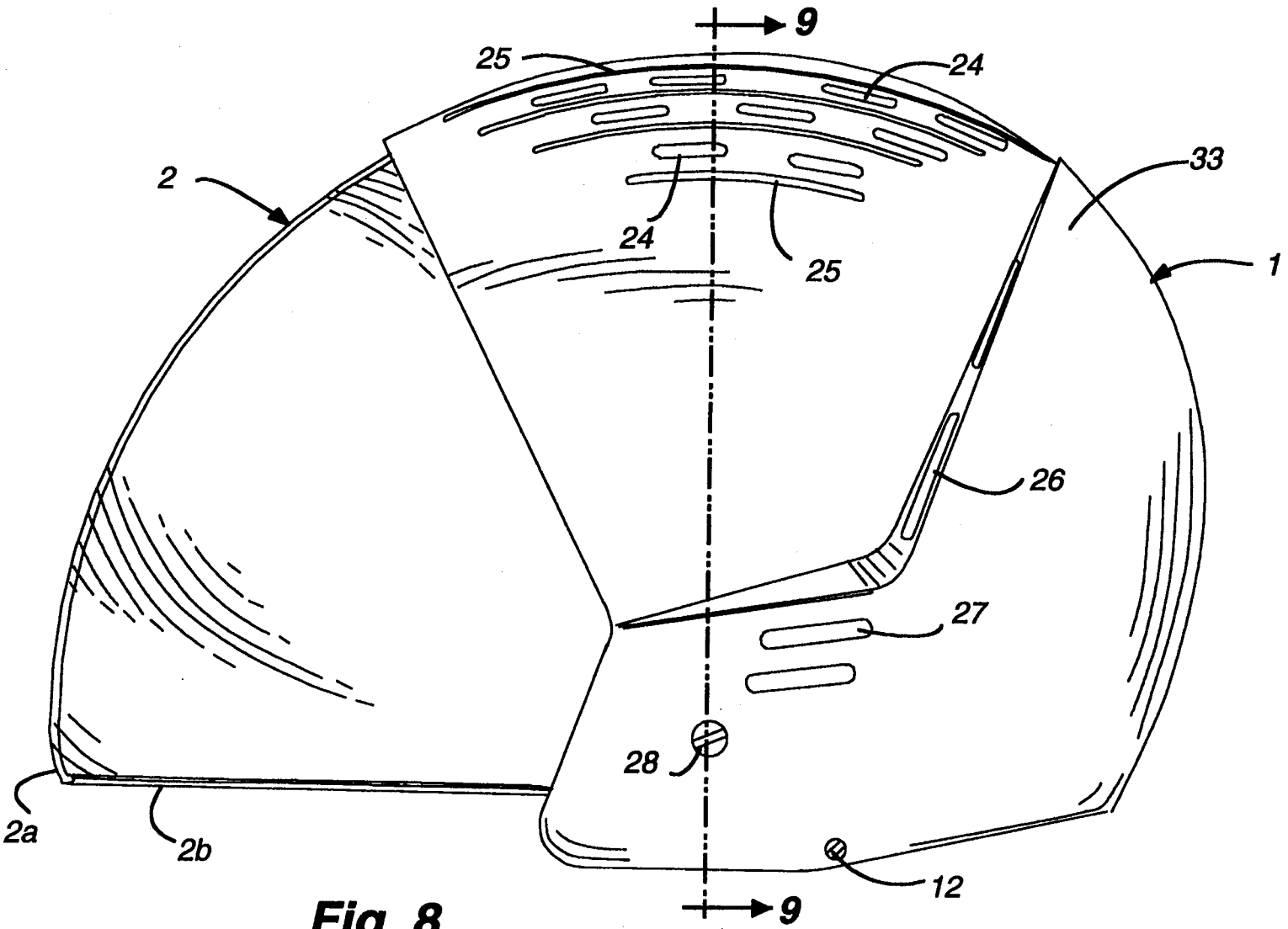
FIG. 8 is a side elevation of the shell of the helmet of the first embodiment with the visor in the closed position.
Figure 9:
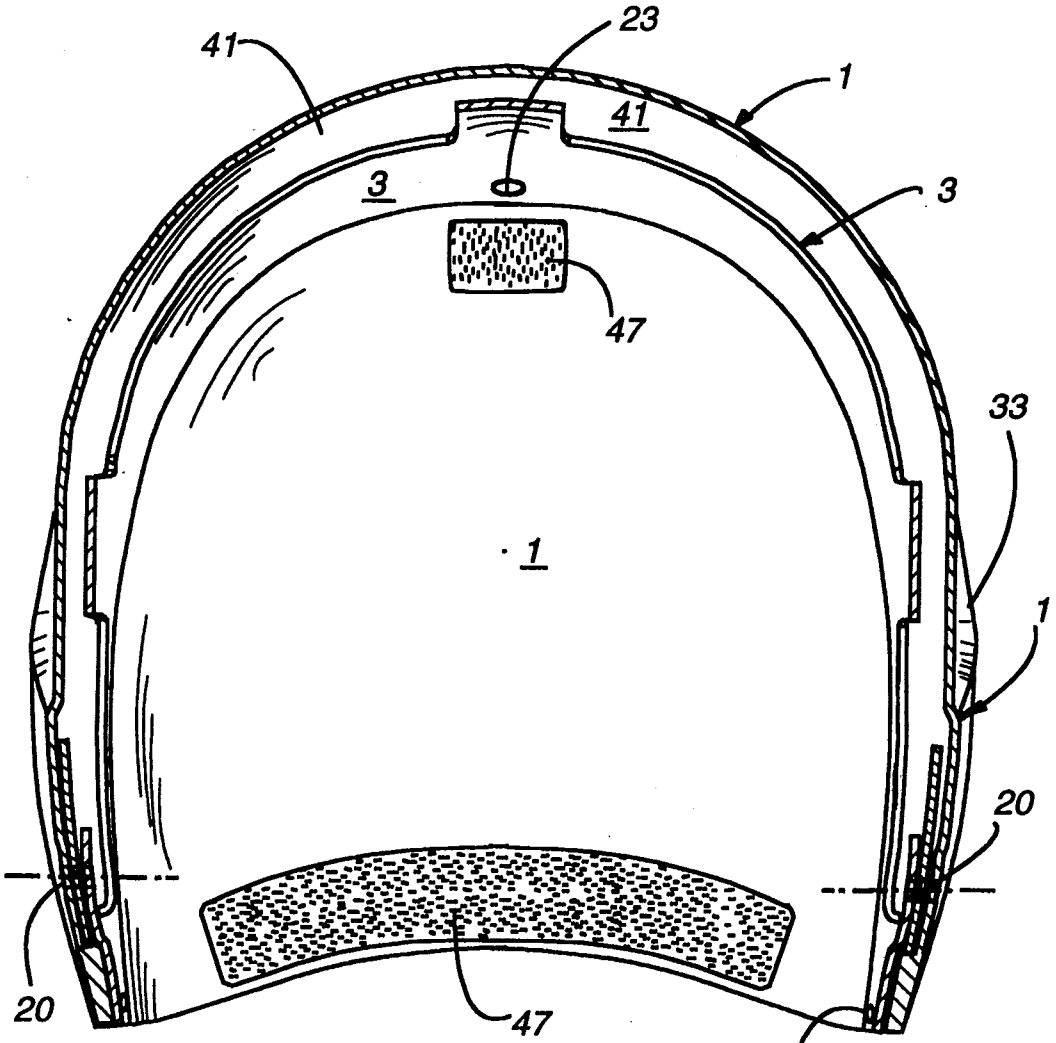
FIG. 9 is a front sectional view taken along section A—A of FIG. 8 showing the position of the inner frame within the shell.
Figure 10:
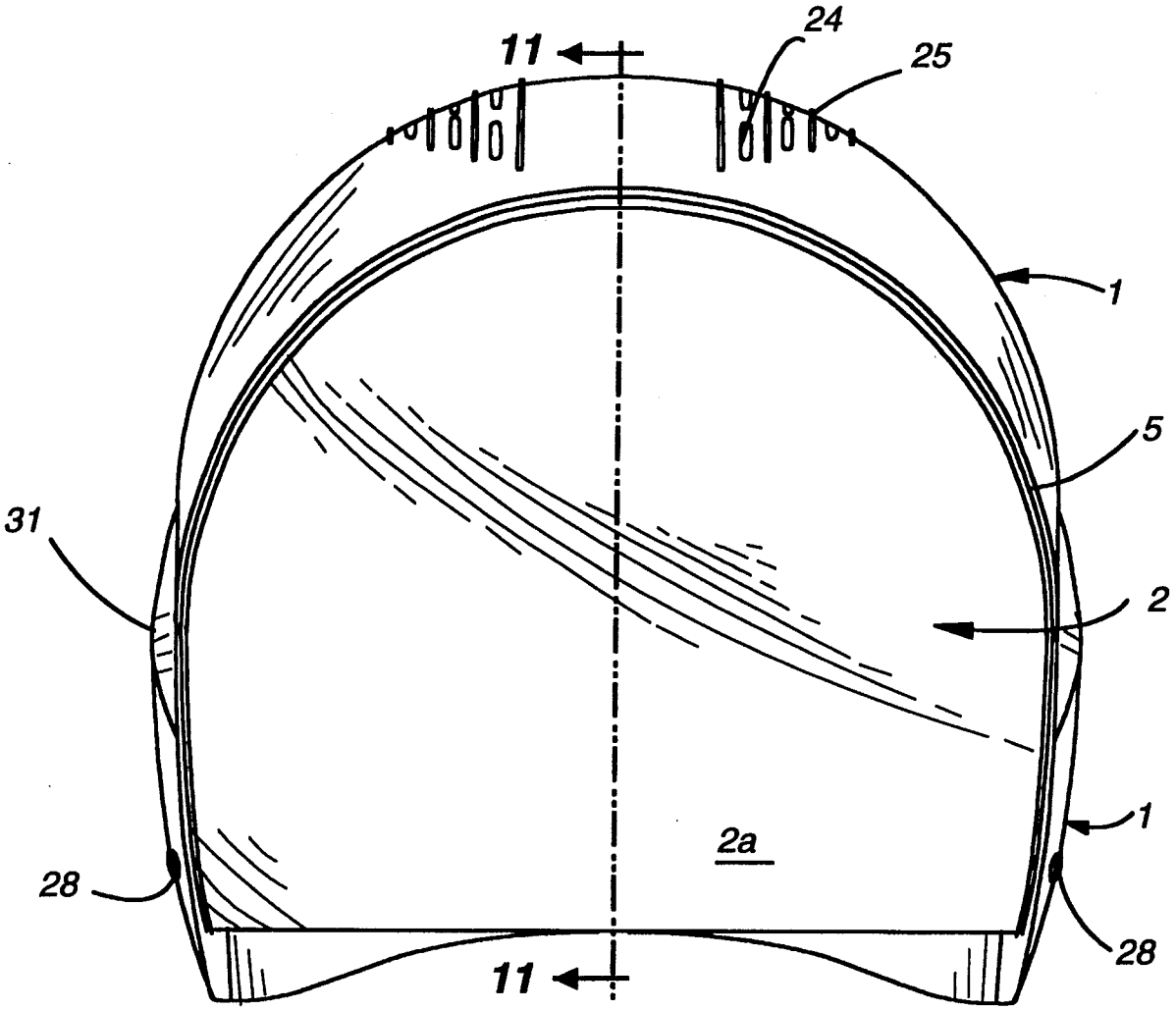
FIG. 10 is a front view of FIG. 8.
Figure 11:
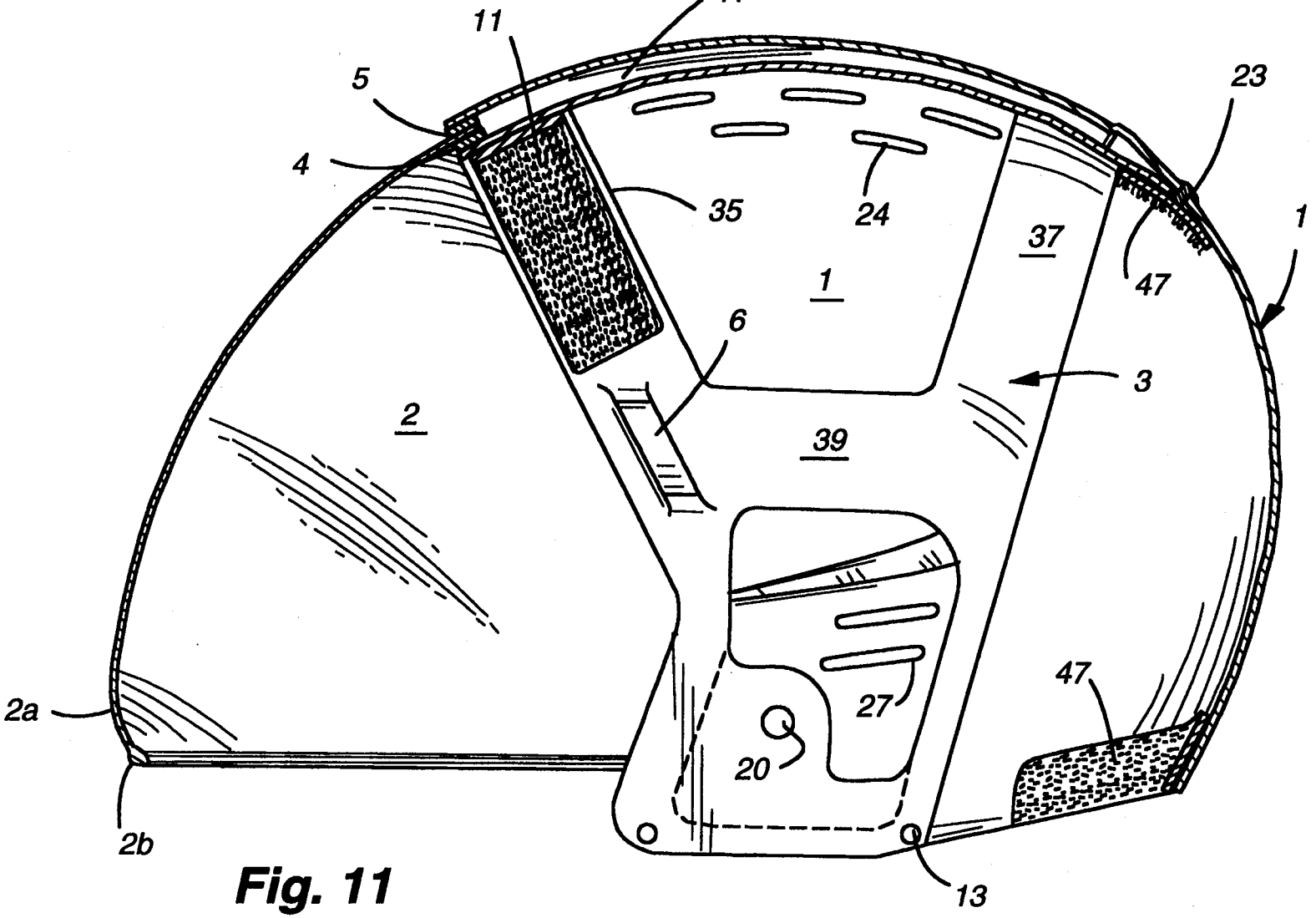
FIG. 11 is a sectional side elevation taken along section B—B of FIG. 10 showing the position of the inner frame within the shell.
Figure 12:
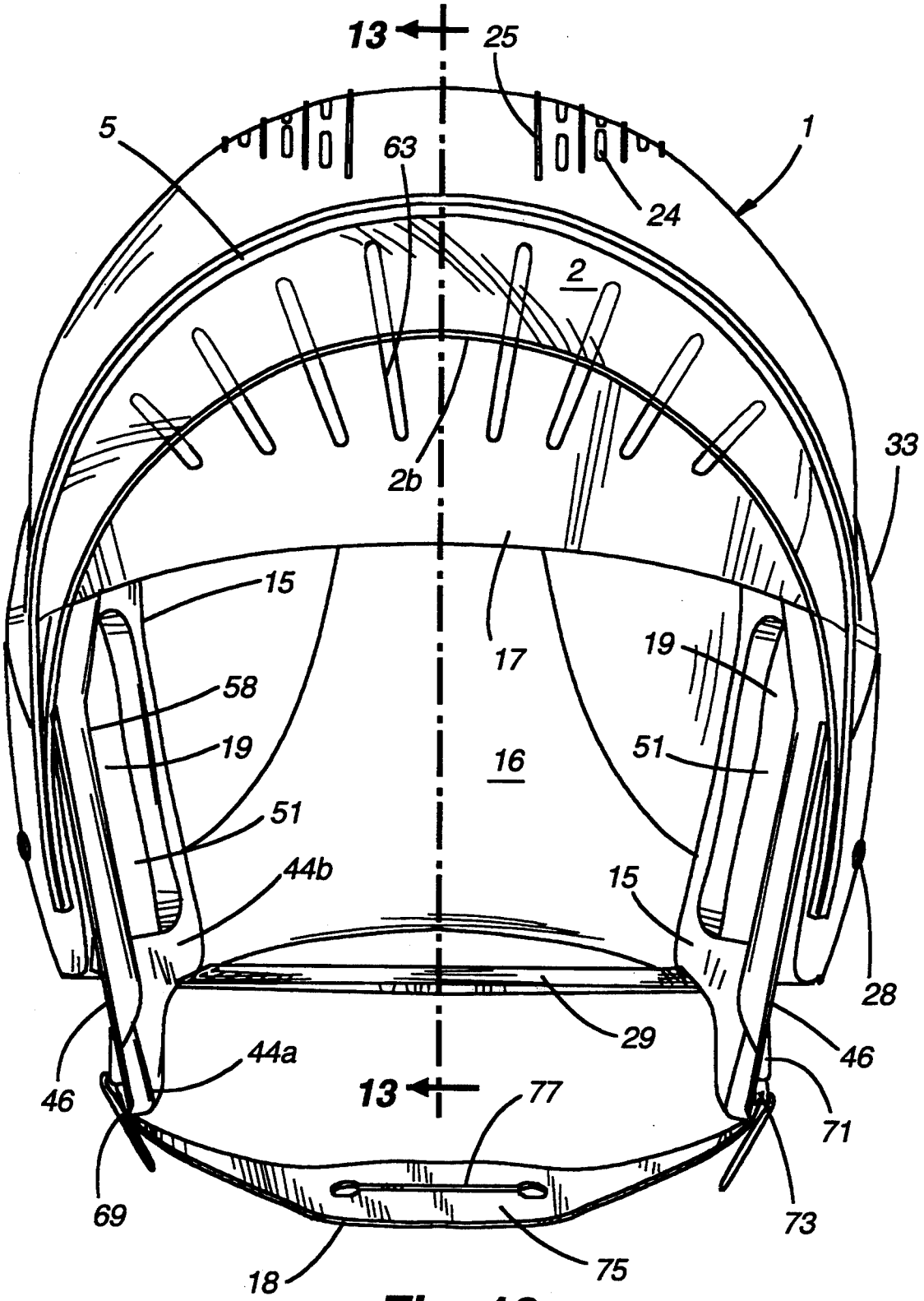
FIG. 12 is a front view of the helmet of the first embodiment comprising the shell, inner frame and head retention means, with the visor in the open position.

The visor 2 furthermore is slightly sculptured inwardly of the general locus of curvature 2*a* thereof proximate to the leading edge 2*b*. Consequently the leading edge 2*b* presents a closed face to impinging air or water to minimize drag, as shown in FIG. 8, as opposed to a peak which would tend to catch air or water reducing performance and in certain circumstances, causing the helmet to be forced off of the head of the wearer.

The inner frame 3 is preferably formed of highly compressed polystyrene material, but may also be formed of a poly-carbonate plastic. The inner frame 3 is itself lune shaped to correspond with the inner contour of the shell. The frame is of an open lattice type structure having a front longitudinal portion 35, a rear longitudinal portion 37 and a plurality of latitudinally extending ribs 39 which interconnect the front and rear longitudinal portions. The ribs 39 extend sufficiently to provide support for the parietal portion of the wearer's cranium and prescribe an outer surface for the frame which is marginally spaced from the inner surface of the shell 1 to define a lune shaped cavity 41 across the helmet. The cavity 41 accommodates the visor 2 when disposed in the open position and allows movement of the visor, latitudinally along the cavity to the closed position.

The frame 3 is pinned to the outer shell 1 by means of the pins 28 accommodated within apertures 20 of the frame and shell disposed at opposite ends of the frame, fixed pins 12 accommodated within apertures 13 and 14 of the frame and shell respectively, disposed generally rearwardly of the pins 28, and a rear pin 23 disposed centrally at the top of the frame and shell, rearwardly of the cavity 41.

The frame is provided with a pair of guides at oppositely spaced apart locations along the front longitudinal portion 35. The guides project inwardly from the inner surface of the frame to each define an eye for locating the head retention means 31 within the helmet in a manner to be described later.

A wiper means is disposed at the interface between the shell 1 and the visor 2 and comprises two halves 4 and 5. One half 5 is fixedly mounted to the shell proximate the periphery of the open front and has inwardly projecting blades to engage the external face of the visor. The other half 4 is fixedly mounted to the outer surface of the inner frame directly opposite to the one half 5 so as to define a space therebetween. The other half 4 is also provided with a plurality of wiper blades which engage the internal face of the visor.

The head retainer or retention means 31 essentially comprises a flexible hood which is adjustably mounted within the shell and inner frame of the helmet to retain the wearer's head therein. The hood comprises discrete segments which include a top cover 15, a back support 16, a pair of side covers 8, a front band 17 and a bottom strap 18. The top cover 15, rear support 16 and front band 17 are preferably formed of resilient neoprene material to provide comfort, insulation and support for the head of the user. The side covers 8 are principally made of substantially non-extendible, flexible plastic which are integrally attached to the top cover 15 to provide both resilient and semi rigid covering at the sides of the wearer. The bottom strap 18 is formed of any suitable flexible but substantially non-extendible material which has adequate strength to retain the head of the wearer within the retention means.

The top cover 15 has a sufficient arcuate extent to cover the parietal portion of the wearer's cranium and extend down either side of the helmet to cover the temporal portion of the wearer's cranium in combination with the side covers 8. The top cover 15 is provided with a plurality of holes 43 arranged in a matrix across the top longitudinal extent of the cover for ventilation purposes. The top cover 15 is also provided with detachable and adjustable fastening means for fastening the cover to the shell or inner frame. In the present embodiment, this fastening means takes the form of a surface contact fastener, such as a hook and loop fastener, one form of which is sold under the trade mark VELCRO. Hook and loop fasteners include a hook strip and a loop strip secured respectively to parts to be separately secured together, one part 10 of which is disposed upon the leading peripheral edge of the cover and the other part 11 of which is disposed opposite thereto along the leading peripheral edge of the inner frame. The top cover 15 is also provided with holes 49 on either side to encircle the ears of the wearer, and rearwardly and forwardly extending lateral flaps 44*a* and 44*b* respectively, disposed beneath the holes 49 and which are adhered or welded to the inner surface of the side covers 8. Thus the top cover is further fastened to the inner frame by the pins 12 at either side which are respectively affixed to the rearwardly extending lateral flaps 44*b*.

The shell is cut with a frontal periphery defining a centrally highly-arched portion which fully exposes both the face and forehead of the user while protecting the central, side and back portions of the user's head.

The back support 16 is provided to cover the occipital portion of the wearer's cranium and is also provided with detachable and adjustable fastening means for fastening the same to the shell. The back support is disposed adjacent to the rear of the top cover 15 and is shaped so as to combine with the top cover to form openings therebetween for ventilation purposes of the occipital portion of the head. The fastening means are also in the form of a surface contact fastener one part 45 of which is disposed in a triangular arrangement on the back support and the other part 47 of which is mounted in opposite locations on the inner surface of the shell 1. The side covers 8 are disposed to cover the ears and the temporal portion of the wearer's cranium to not only protect these parts of the head of the wearer from physical impact but also to prevent access of the wind to the ears of the wearer. Furthermore, means are provided for preventing the retention of water in the proximity of the ears. The side covers are each formed essentially of two parts, one part comprising a flexible and substantially non-extendible frame 46, and the other part comprising a resilient skin 51 of neoprene material. The frame 46 is formed with a central hole 50 through which the ear of the wearer may project, and has a front upward projection 53 to cover the temple region of the wearer, a front downward projection 54 and a rear downward projection 54*b*. Each frame 46 is adhered or welded to the outer surface of the respective sides of the top cover 15 so that the holes 50 of the frames align with the holes 49 of the top cover, and the remainder of the frames are coextensive with the sides of the top cover. The skin 51 is adhered or welded around the periphery of each hole 50 of the frames to form a pouch 19 in each side cover which accommodates the ears of the wearer. A drain 7 is disposed in the region of each pouch 19 which communicates with the base of the outer ear canal of the wearer. The drain 7 is formed by adhering or welding the skin 51 of material about the entire periphery of the hole 50 except for a small opening provided at the base thereof towards the anterior of the pouch. The opening is accentuated by the provision of a small recess 56 formed in the frame 46, which communicates with the hole 50 and by the formation of a pucker in the skin over this recess. The hole 49 is sufficiently large to accommodate the ear flap of the wearer and the drain ? is disposed so as to communicate with the outer ear canal of the ear when the ear is disposed within the pouch 19.

The side covers are attached to the frame and shell by means of the pin 12 and also by the front band 17 cooperating with the front upward projection 53 of the side covers. The front upward projection 53 of the side covers is provided with a longitudinally extending slit 55 through which a corresponding guide 6 of the inner frame may protrude. The manner by which the head band cooperates with the side cover to fix the same shall be described hereinafter.

The front downward projections 54 are each terminated with a slot 67 or fastener 69 to provide a fixing point for the ends of the bottom strap 18. Similarly, the rear downward projections 54*b* are each terminated with a slot 68 to provide a fixing point for the ends of a rear strap 29.

The rear strap 29 may be provided with suitable means for adjustment and is included to allow support of the neck of the wearer and assist in retentioning of the head within the helmet.

The front band 17 is adapted to cover the frontal portion of the wearer's cranium across the forehead and is provided with a pair of opposing straps at opposite ends of the band. The front band 17 is flexible, and sufficiently resilient to be expandable for it to be stretched or flexed and placed over the user's forehead when the user dons the helmet. The band is provided with detachable and adjustable fastening means at each end of the straps and centrally to fasten the same to the top cover 15. The straps 57 are each of sufficient size to be threaded through the eye formed by the guide 6 of the inner frame when the guide is protruding through the slot 55 of the corresponding side cover and thus function to pin the upwardly extending portions 53 of the side covers to the inner frame 3. Thus the guides 6 ultimately repose in juxtaposition between the side covers 8 and the top cover 15, and are additionally padded from the head of the wearer by the provision of a hem 58 along the leading front edge of the top cover.

Consequently, the band 17 is adjustable to the head of the wearer to prevent the hair of the wearer from falling over the face and water entering the shell from draining over the face of the wearer.

Figure 13:
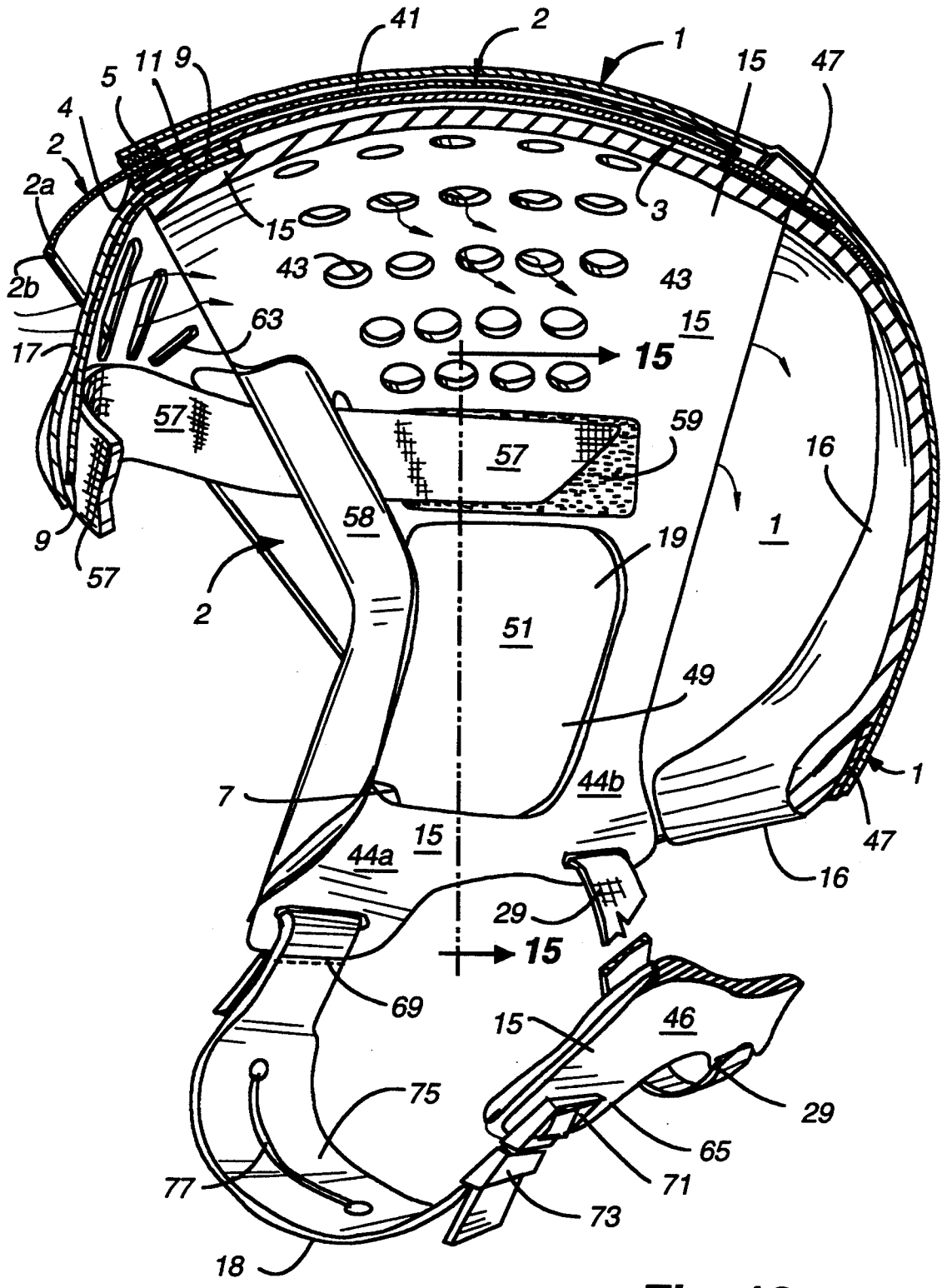
FIG. 13 is a sectional side elevation taken along section C—C of FIG. 12.
Figure 14:
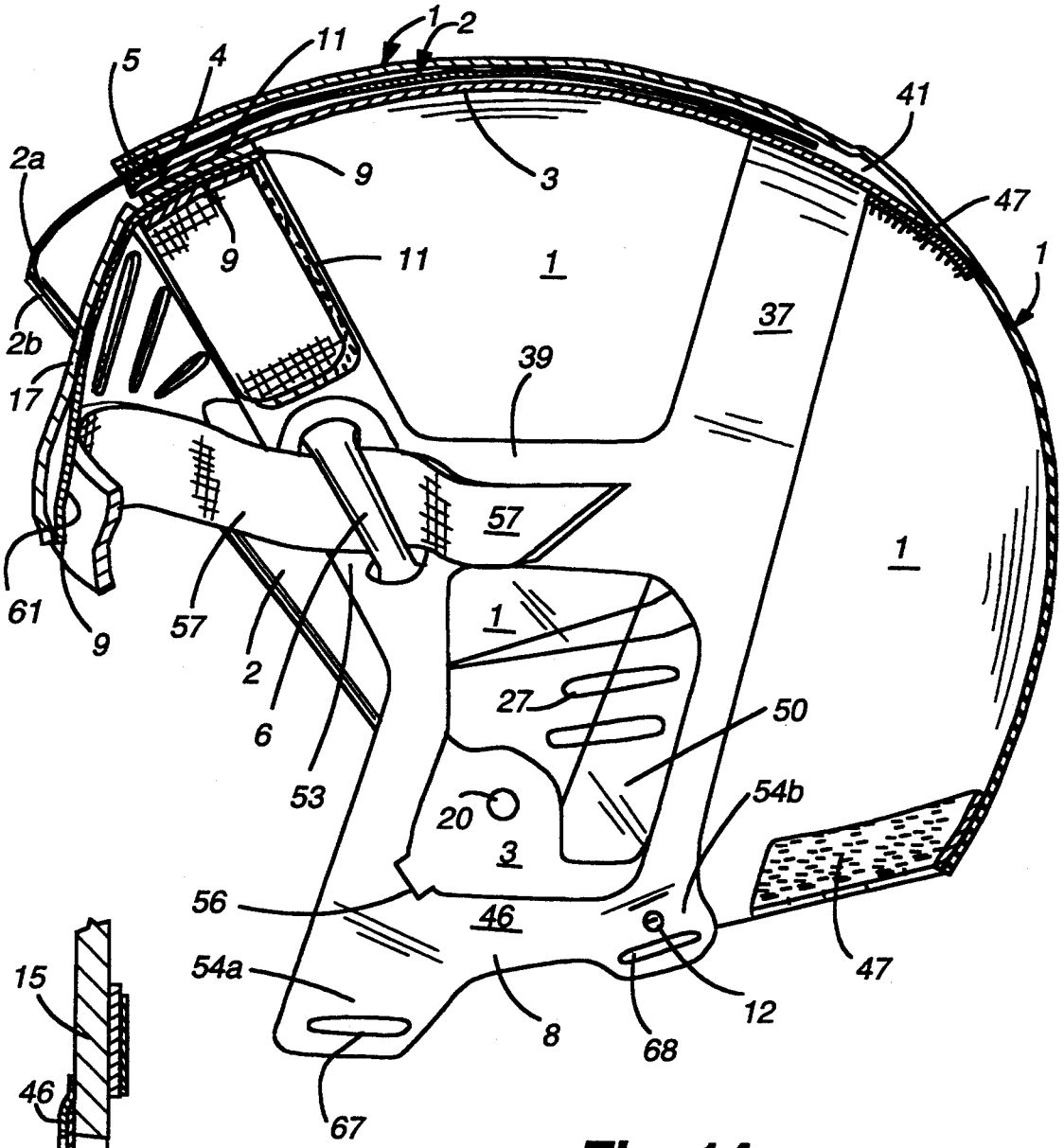
FIG. 14 is a fragmentary sectional side elevation taken along section C—C of FIG. 12 with the top cover, back support and bottom strap of the head retention means removed.
Figure 15:
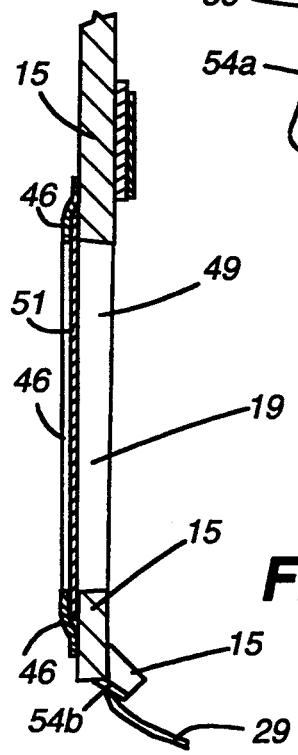
FIG. 15 is a fragmentary sectional view taken along section D—D of FIG. 13.

The fastening means at the end of the straps 57 are also in the form of a surface contact fastener, one part of which is mounted to the outer face of each strap and the other part 59 is mounted to the inner surface of the top cover behind the guide 6 of the inner frame in the manner shown at FIGS. 13 and 14 of the drawings. The centrally disposed fastening means is also in the form of a surface contact fastener, one part 61 of which is provided on a strip 9 which extends from the low periphery of the band to beyond the upper periphery of the band and the other part of which is provided by the cooperating parts 10 and 11 of the fastening means of the top cover. Thus, the strip 9 is interposed between the fastening means of the top cover to enable attachment of the front band to both the inner frame and the top cover simultaneously, and allow for height adjustment of the band along the forehead of the wearer.

The band is also provided with a series of holes 63 disposed intermediate the expansive portion of the band between the opposing straps 57 for ventilation purposes across the forehead.

The band effectively functions to seal the top of the interior of the shell to the wearer's head to prevent the hair of the wearer from falling over the face and water entering the shell from draining over the face of the wearer.

With the foregoing construction including the highly arched frontal periphery portion of the shell and a sufficiently resilient or expandable front band 17, the safety helmet can be readily donned by simply expanding the sides of the shell and the band 17, placing the shell over the head, and allowing the band 17 to contract over the forehead to snugly engage and protectively cover the forehead together with the contracting of the sides of the shell to provide an overall snug fit of the helmet.

The bottom strap 18 is provided with fastening means at either end to attach to the front downward projection 54 of each side cover 8 so as to engage the mandible of the wearer. In the present embodiment, one side cover 8 is provided with a slot 67 on its front downward projection 54 to receive one end of the strap 18. The other side cover has its front downward projection 54 fitted with one part 71 of a quick release latch, the other part 73 of which is provided at the terminal end of the bottom strap 18. A buckle 69 is provided on the one end of the strap to fix the strap to the slot 67.

The other part 73 of the quick release latch has suitable adjustment means incorporated therein to adjust the length of the strap so as to retention the underside of the wearer's mandible when fastened. The bottom strap is provided with a broadened portion 75 intermediate its opposing ends which has a central longitudinally extending slot 77 formed therein. The slot 77-is disposed so as to situate along the junction between the neck and the mandible of the wearer so as to facilitate support of the helmet upon the wearer without detracting from the comfort of the wearer.

Figure 4:
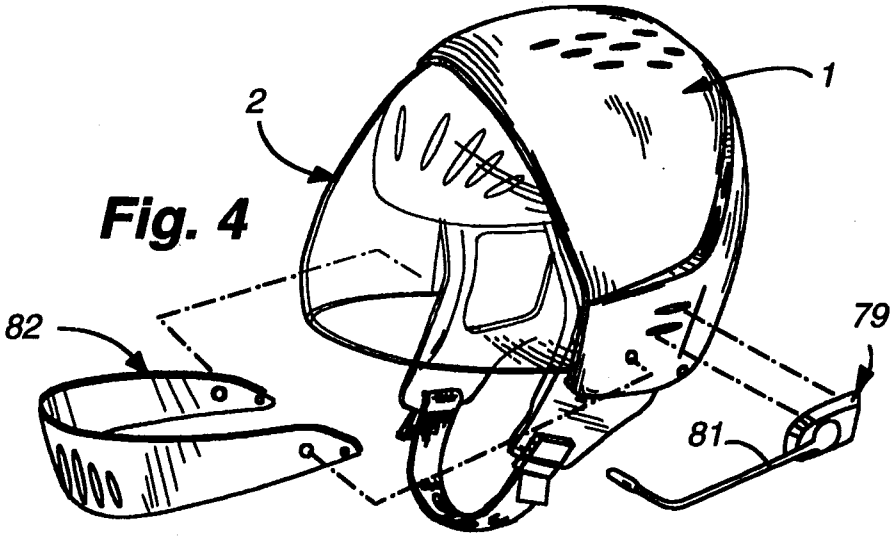
FIG. 4 is a perspective view of the helmet of the first embodiment showing in exploded arrangement the provision of communication means and a chin guard.

In the present embodiment, the helmet can be provided with bidirectional or unidirectional communication means for communicating to a remote location or vice versa. The communication means 79 is shown at FIG. 4 and incorporates a microphone mounted at one end of an arm 81, a transmitter (not shown) for transmitting voice messages from the wearer of the helmet to a remote location, an earphone (not shown) and a receiver for receiving messages from a remote location. An aerial (not shown) may be incorporated into the design of the shell 1 to facilitate communications.

The helmet may also be provided with a chin guard 82 as shown at FIG. 4 of the drawings to provide protection to the chin of a wearer, if required.

In operation, the helmet initially has the various segments of the head retention means adjusted relative to the shell 1 and the inner frame 3 so as to intimately engage the head of the wearer while maintaining comfort. Upon obtaining the required adjustment by virtue of the various fastening means incorporated into the segments, the helmet may be positioned over the head of the wearer for use and the bottom strap 18 fastened by means of the quick release latch. The visor may then be simply moved to the closed position as shown at FIGS. 2 and 3 of the drawings in response to the application of a prescribed motive force as provided by the hand of the wearer pulling down on the visor to present clean inner and outer surfaces by the action of the wiper means. If desired, the visor can be adjusted to any intermediate position between the open fully open and fully closed positions by virtue of the frictional engagement of the halves of the wiper means upon the visor 2. If any water vapor or drops situate upon the surface of the visor while engaged in a recreational or sporting activity, the surface of the visor may simply be cleaned by the wearer pushing up on the visor moving it to the open position as shown at FIG. 1 of the drawings so as to allow the wiper means to wipe the water vapor or drops from both the inner or outer surfaces of the visor.

By adopting wiper blades as opposed to brushes, the retention of foreign particles such as sand within the wiper means mechanism, which could cause scratching, is obviated.

In addition, ventilation of the head is maintained by allowing air to circulate through the various holes and apertures provided in the shell, inner frame and head retention means, without accessing the region of the ears.

In activities or sports where foreign matter such as sand is deposited within the helmet, the helmet can be easily cleaned by detaching the various fastening means of the head retention means so as to expose the inner confines of the shell and frame.

An important advantage of the present embodiment in addition to the provision of the wiper means for the visor, is the segmented design of the head retention means, which allows for adjustment to suit the particular size and shape of the head of the wearer. Furthermore the provision of a substantially non-extendible frame within the side covers and a non-extendible bottom strap, when fastened, provides a fixed helmet which cannot be removed from the head, while the flexibility and resiliency of the remainder of the head retention means enables intimate engagement with the head to mitigate water and wind entering the ears. Thus protection of the head is maintained without foregoing freedom of movement.

The second embodiment is in fact the preferred embodiment of the invention and is directed towards a high performance sport safety helmet which is substantially similar to the safety helmet described in the first embodiment of the invention except that instead of comprising an adjustable and removable head retention means, the helmet comprises an inner shell liner and a front band which are fixedly and integrally attached to the shell and inner frame.

As shown in FIGS. 16 to 21, the high performance sport safety helmet 101 of the present embodiment comprises an outer shell 103, a visor 105, an inner frame 107, an inner shell liner 109, a front band 111 and a chin strap 113.

Figure 17:
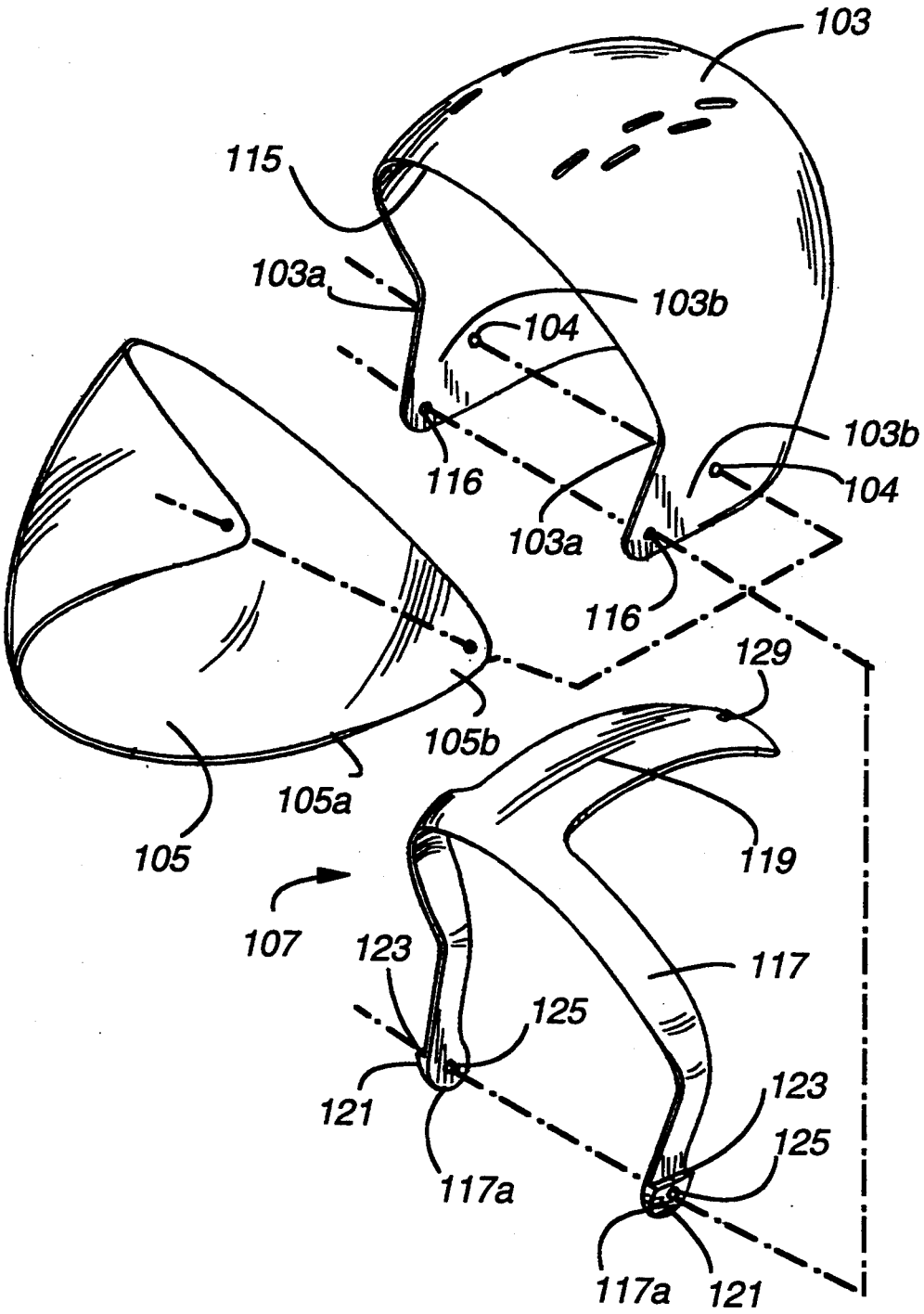
FIG. 17 is a perspective view of the shell, inner frame and visor in accordance with the second embodiment, similar to FIGS. 5, 6 and 7 of the first embodiment.
Figure 18:
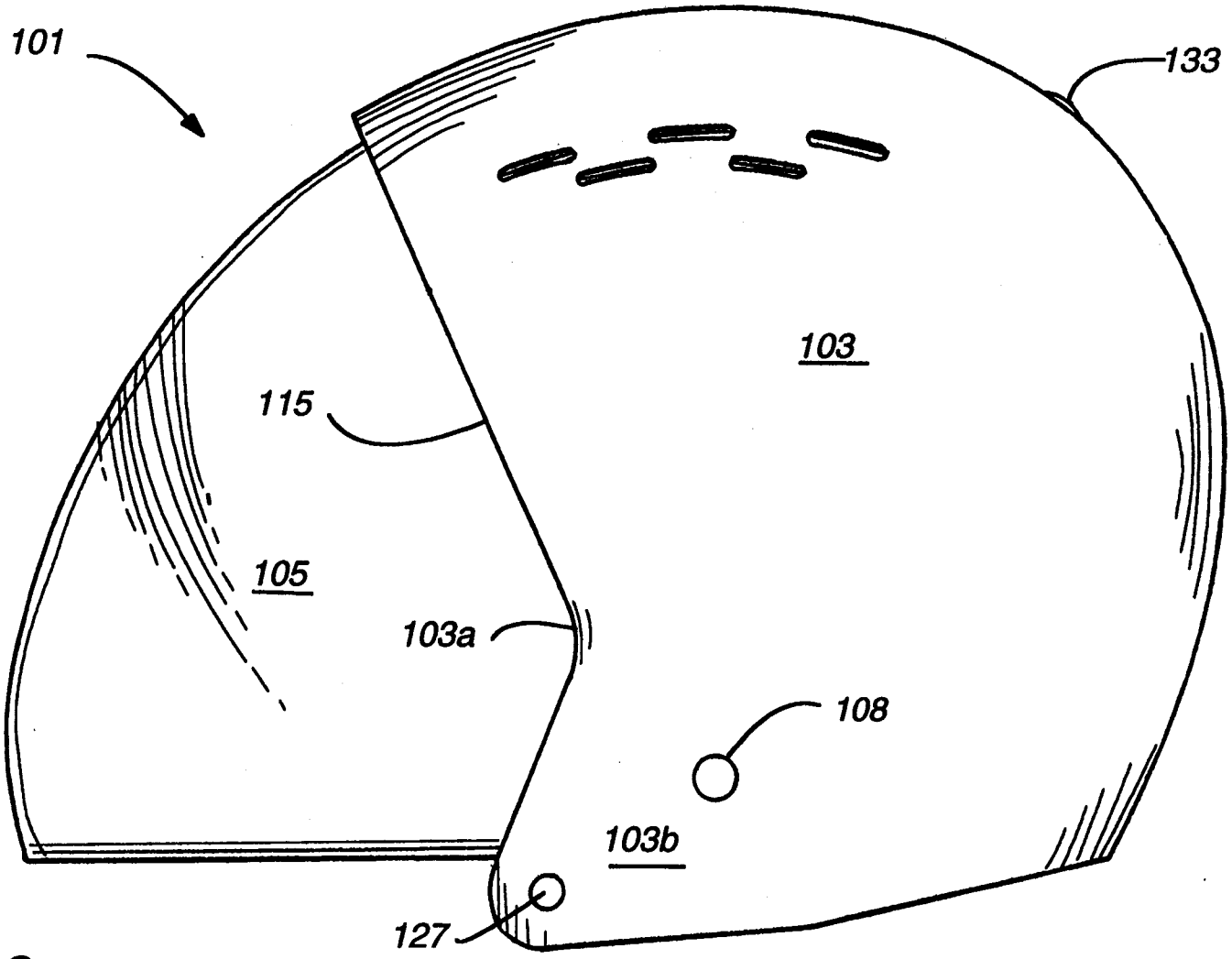
FIG. 18 is a side elevation of the shell of the helmet of the second embodiment with the visor disposed in the closed position.
Figure 19:
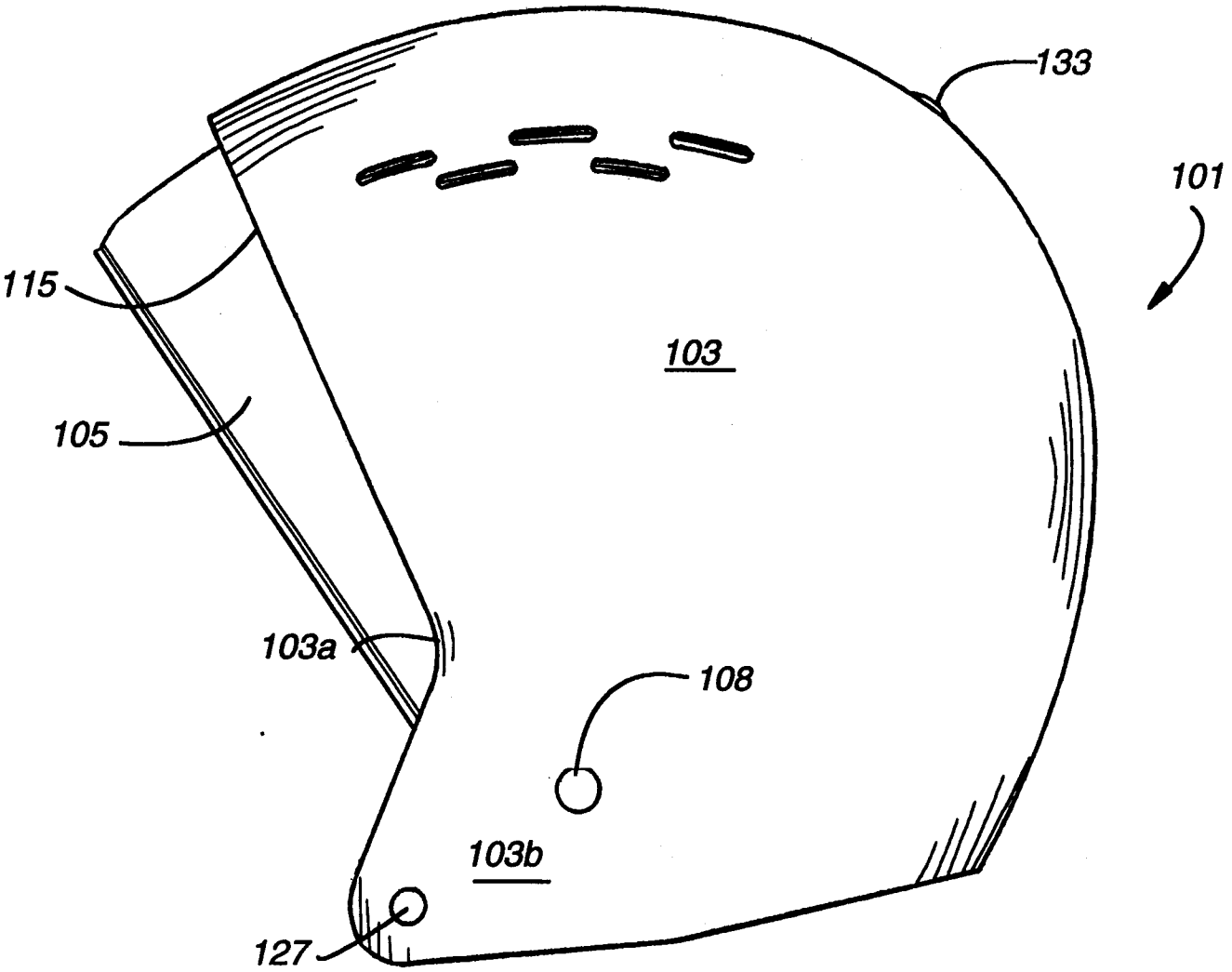
FIG. 19 is a side elevation of the shell of the helmet of the second embodiment with the visor disposed in the open position.

The outer shell 103 is substantially the same as the outer shell of the first embodiment, importantly incorporating the characteristic high cut of the frontal periphery of the helmet to define the centrally arched portion 115 which forms an open front fully exposing the face in a major portion of the forehead of the wearer. Accordingly, as shown in FIG. 17, the centrally arched portion 115 sweeps back rearwardly from the top of the outer shell 103 to define an innermost recessed portion 103*a* on each side of the shell at a prescribed height above the bottom periphery of the shell, proximate to the front of the ear lobe, to define lobe portions 103*b* of the shell which project forwardly to cover the ears of the wearer. Consequently, the rear sweep of the centrally arched portion 115 optimizes the peripheral vision available to the wearer of the helmet.

The outer shell 103 is also formed with a pair of apertures 116 located proximate to the ends of the lobe portions 103*b* of the shell to facilitate fixed attachment of the inner frame 107 thereto. The outer shell 103, however, dispenses with the lune shaped ridge formation of the preceding embodiment and the series of apertures disposed therein, instead adopting a completely smooth and curved outer surface for optimizing the aerodynamic and hydrodynamic efficiency of the helmet, minimizing the number of front confronting surfaces.

The visor 105 is similar to the visor described in the preceding embodiment, except that it is pivotally attached to the outer shell 103 only, and not to the inner frame 107. The visor 105, preferably formed of clear, tinted polycarbonate plastic, is a generally lune shaped shield defining a leading lower edge 105*a* extending between lobes 105*b*. For pivotally attaching the visor 105 to the shell 103, pivot pin receiving apertures 104 are provided in the lobe portions 103*b* of the shell 103. Likewise pivot pin apertures 106 are provided in the lobes 105 of the visor. When the apertures 104 and 106 are aligned, appropriate pivot pins 108 are inserted therein to pivotally secure the visor 105 to the shell 103.

Figure 20:
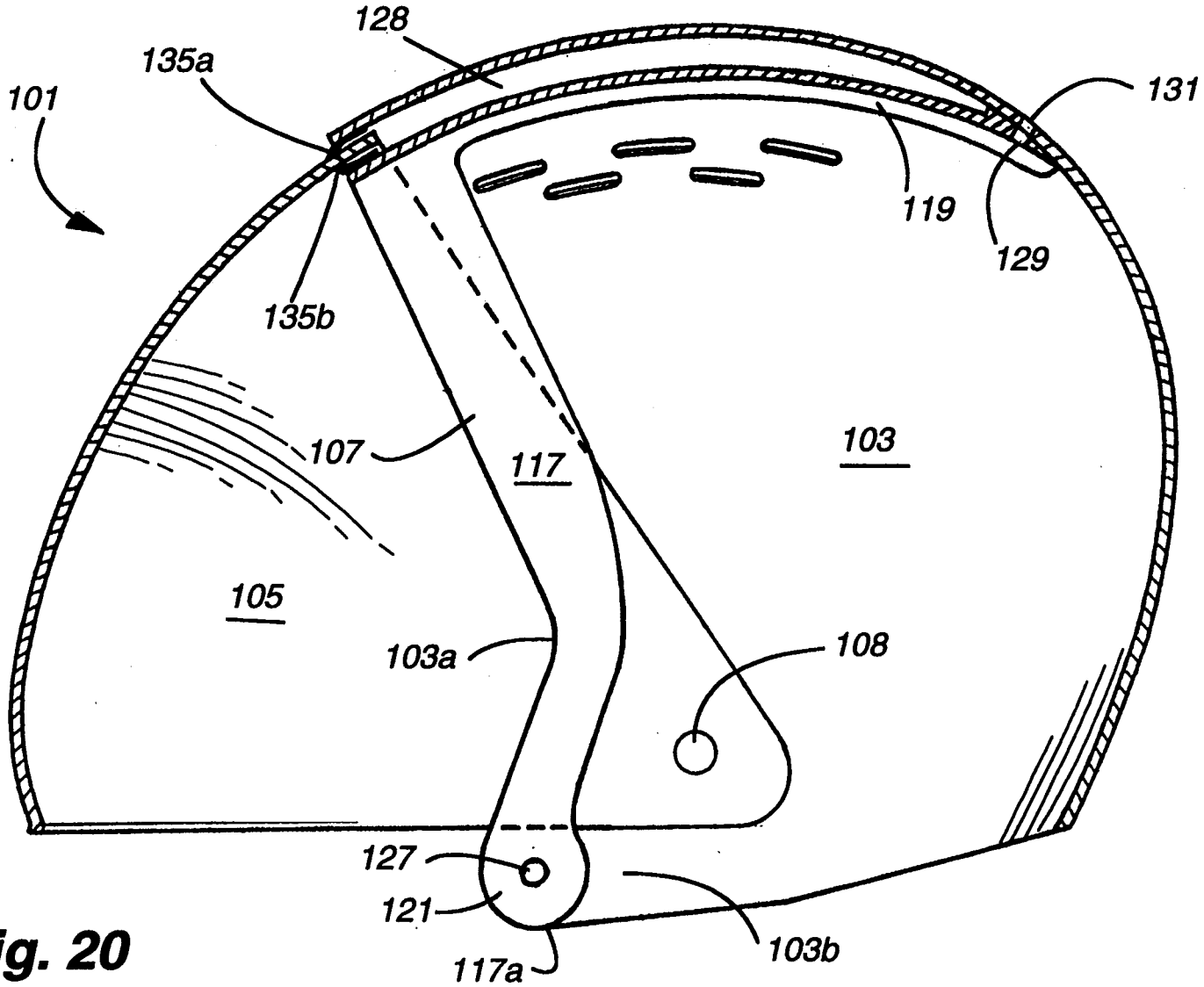
FIG. 20 is a sectional side elevation of the helmet of the second embodiment showing the position of the inner frame within the shell.

The inner frame 107 is marginally similar to the inner frame of the first embodiment, although of simpler design, and forms a lune shaped cavity or space 128 along the inner surface of the shell 103 for receiving the visor 105. To this end, the inner frame 107 comprises a front lune shaped longitudinal portion 117 and a central, rearwardly extending crest portion 119. The opposing distal ends of the front longitudinal portion 117 are each formed with a tapered boss 121 which defines a shoulder or step 123 at a position spaced from the respective terminal ends 117*a* of the longitudinal portion. The outer face of each boss 121 converges from the step 123 to the terminal end 117*a*. Each boss 121 is provided with a centrally disposed aperture 125 for accommodating a pin 127 for fixedly pinning the inner frame 107 to the respective lobe portions 103*b* via the apertures 116 of the outer shell 103. The tapered bosses 121 by virtue of the steps 123, space the outer surface of the longitudinal portion 117 from the confronting inner surface of the outer shell 103 for the purpose of defining the lune shaped cavity 128 for accommodating the visor 105 as shown in FIG. 20.

Figure 16A:
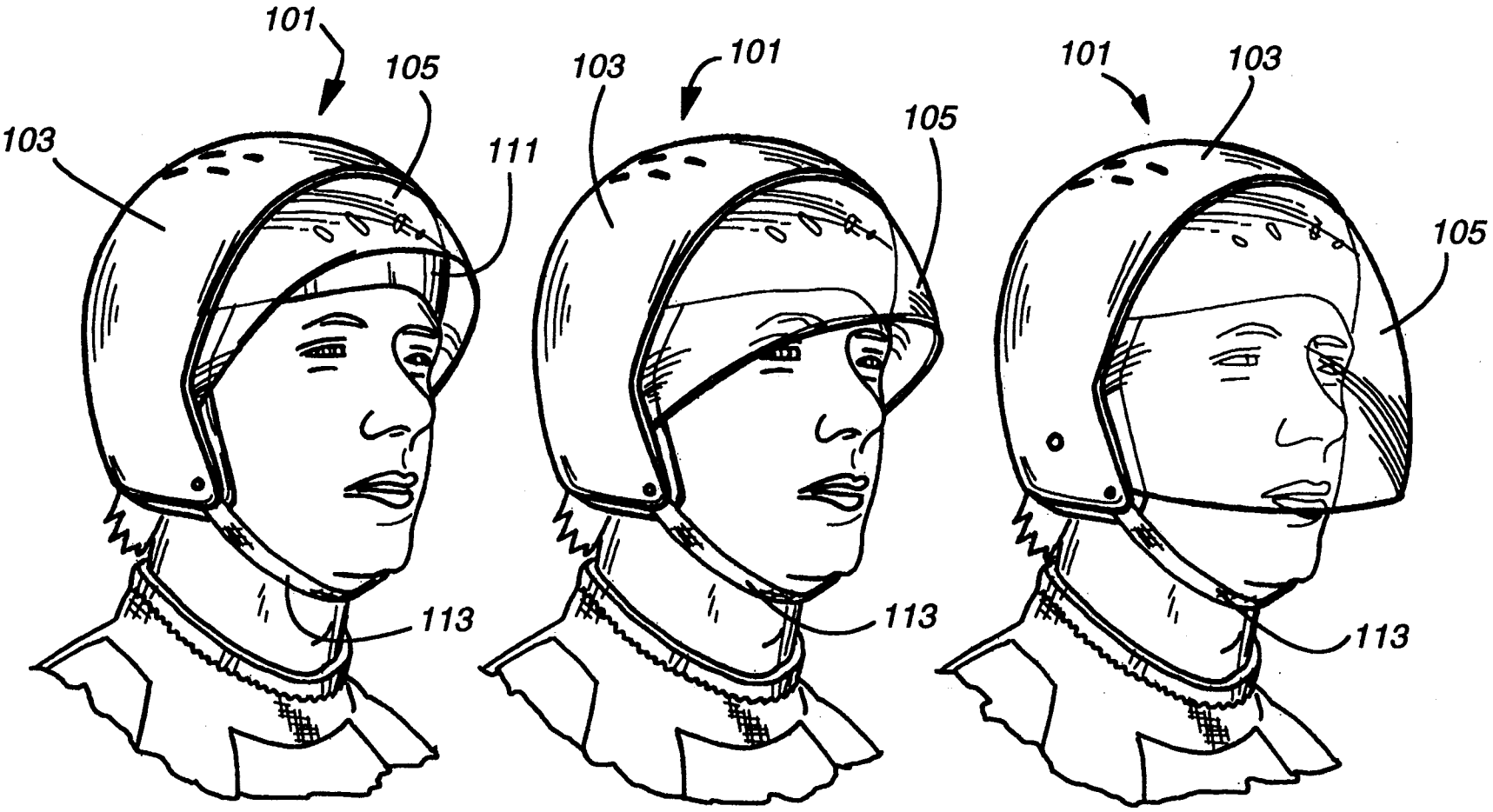

The end of the crest portion 119 is secured to the shell 103. To this end, the crest 119 is provided with an aperture 129 which aligns with a corresponding aperture 131 formed in the outer shell 103 for receiving a central apical pin or rivet 133. The size and shape of the inner frame 107 is complementary to the corresponding portion of the inner surface of the outer shell 103 which surmounts the inner frame so as to continuously form the cavity 127 to accommodate the visor 105 enabling it to move between the open position as shown in FIG. 16*a* of the drawings and the closed position as shown in FIG. 16*c*. In the open position of the visor as shown in FIG. 16*a*, the central apical pin 133 and attached end of the crest portion 119 of the inner frame 107 serve as a stop to prevent the visor from being fully inserted or retracted into the shell. This position of the visor further enables the visor to provide a sunshield or short visor.

Wiper means are similarly provided as in the first embodiment at the interface between the shell 103 and the visor 105, but in the present embodiment the wiper means comprises two opposed pads, an outer pad 135*a* and an inner pad 135*b*. The outer pad 135*a* is fixedly adhered to the inner side of the centrally arched portion 115 of the outer shell, and the inner pad 135*b* is fixedly adhered to the outer side of the corresponding front edge of the longitudinal portion 117 of the inner frame, so that the pads confront each other and positively, frictionally, and wipingly engage the opposing surfaces of the visor 105. The pads extend from one side of the helmet proximate to the innermost recessed portion 103*b* thereof, to the other side of the helmet proximate to the corresponding innermost recessed portion 103*b* thereof. The pads 135 project towards each other to frictionally engage the corresponding surfaces of the visor 105 sufficiently tightly to prevent the ingress of sand or dirt and to enable adjustable positioning of the visor to any intermediate position, such as shown in FIG. 16*b* of the drawings, between its open and closed positions. In order to retain the visor in its selective position, pads are preferred as opposed to blades because the pads tend to frictionally hold the visor in place.

Figure 21:
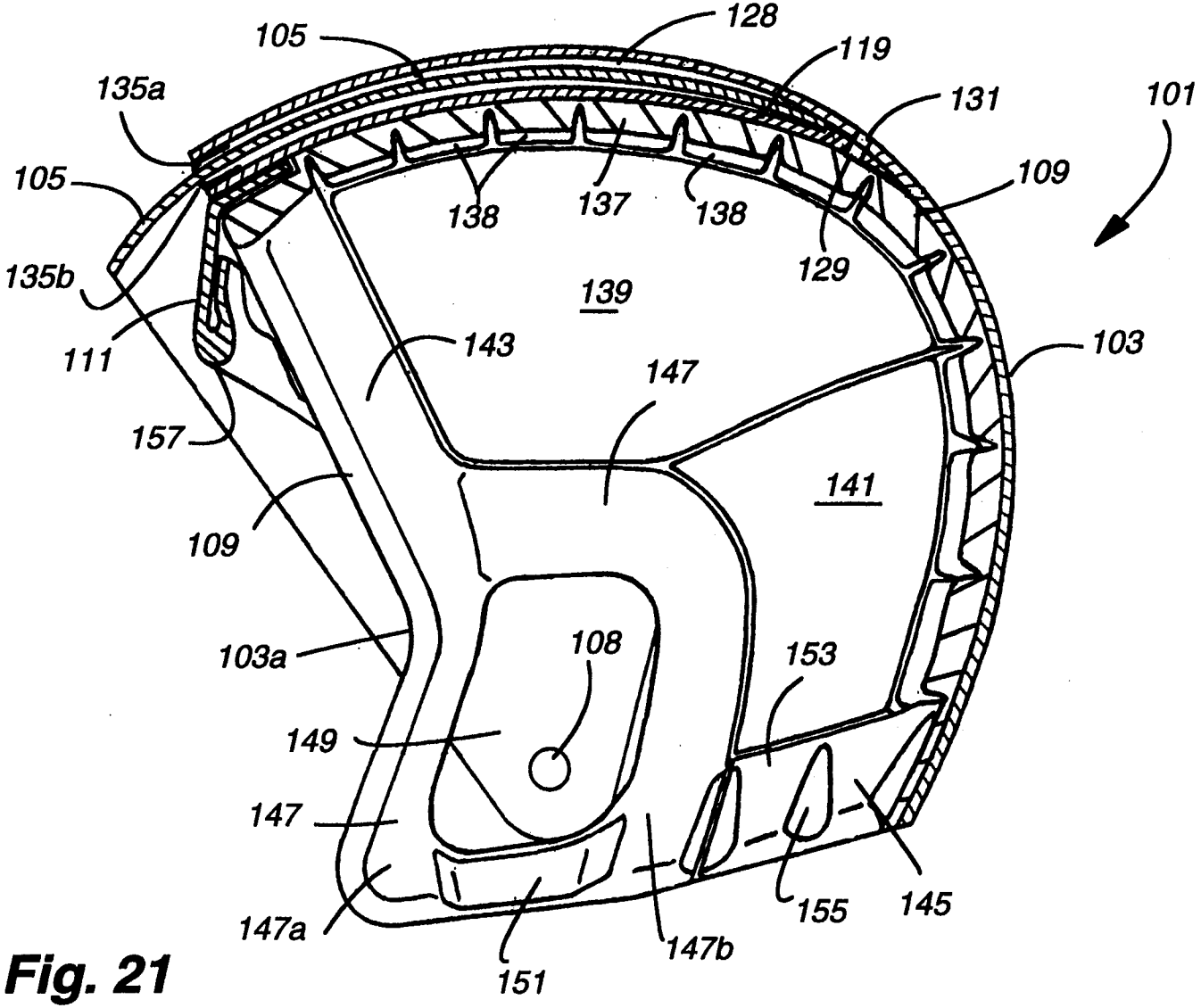
FIG. 21 is a sectional side elevation of the helmet of the second embodiment, similar to FIG. 20, but showing the visor in the open position and the relative position of the front band and inner shell liner.
Figure 22:
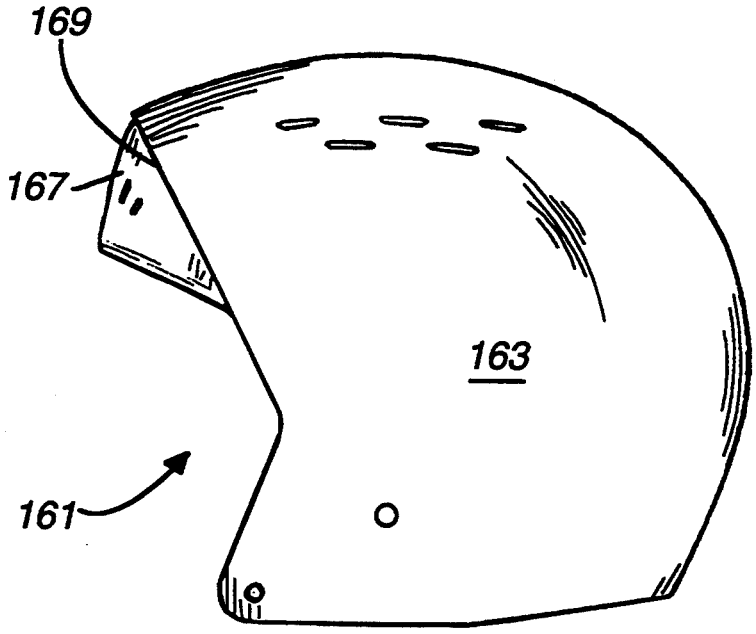
FIG. 22 is a side view of the helmet in accordance with the third embodiment showing the front band extended.
Figure 23:
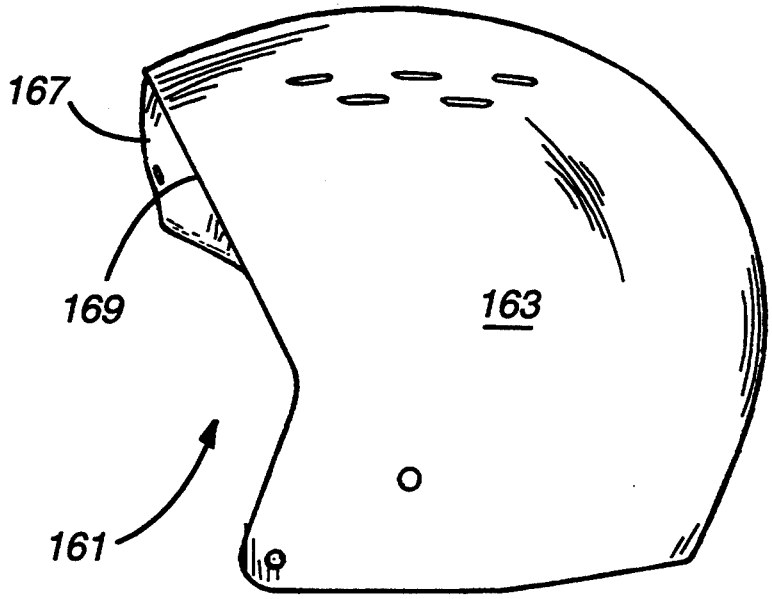
FIG. 23 is a similar view to FIG. 22 except showing the front band relaxed.
Figure 24:
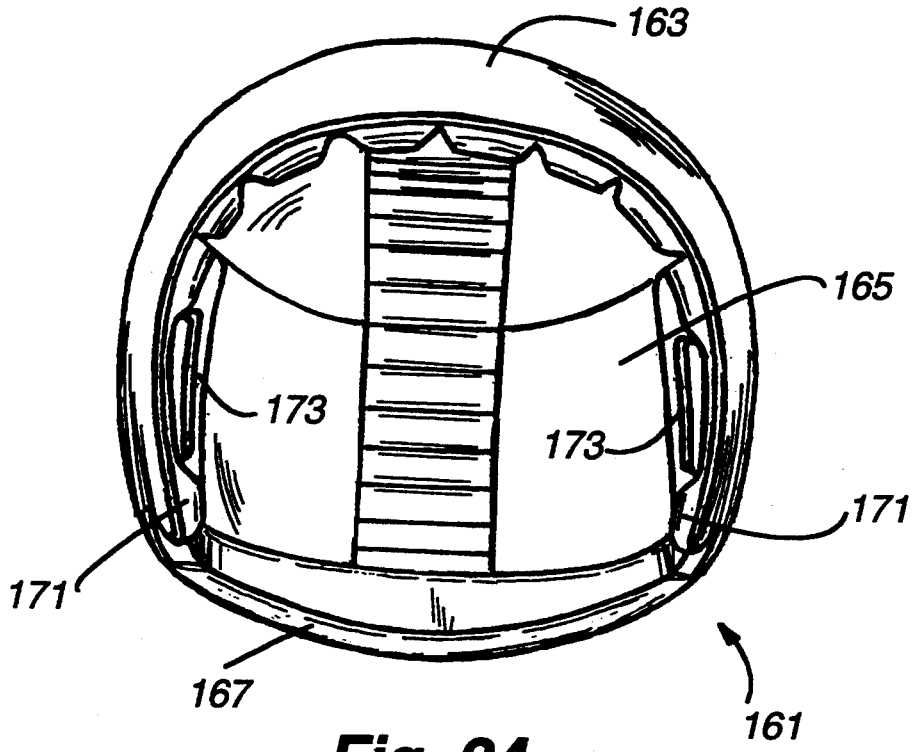
FIG. 24 is a bottom view of the helmet of the third embodiment.
Figure 25:
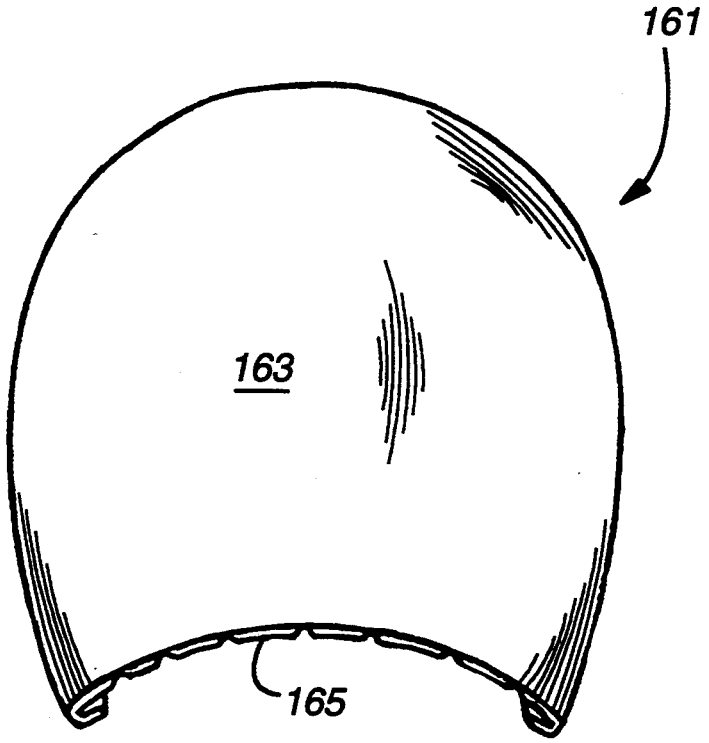
FIG. 25 is a rear view of the helmet of the third embodiment.
Figure 26:
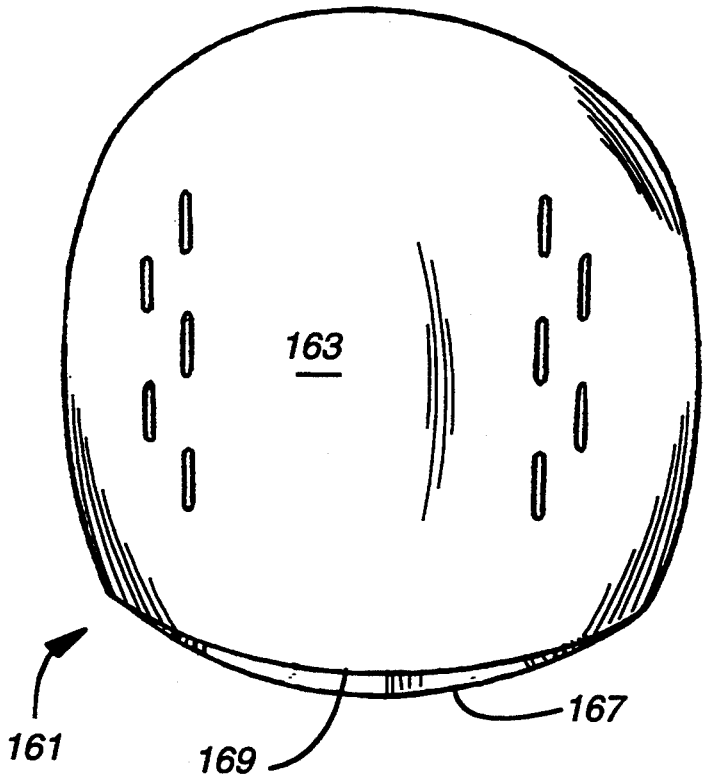
FIG. 26 is a top view of the helmet of the third embodiment.
Figure 27:
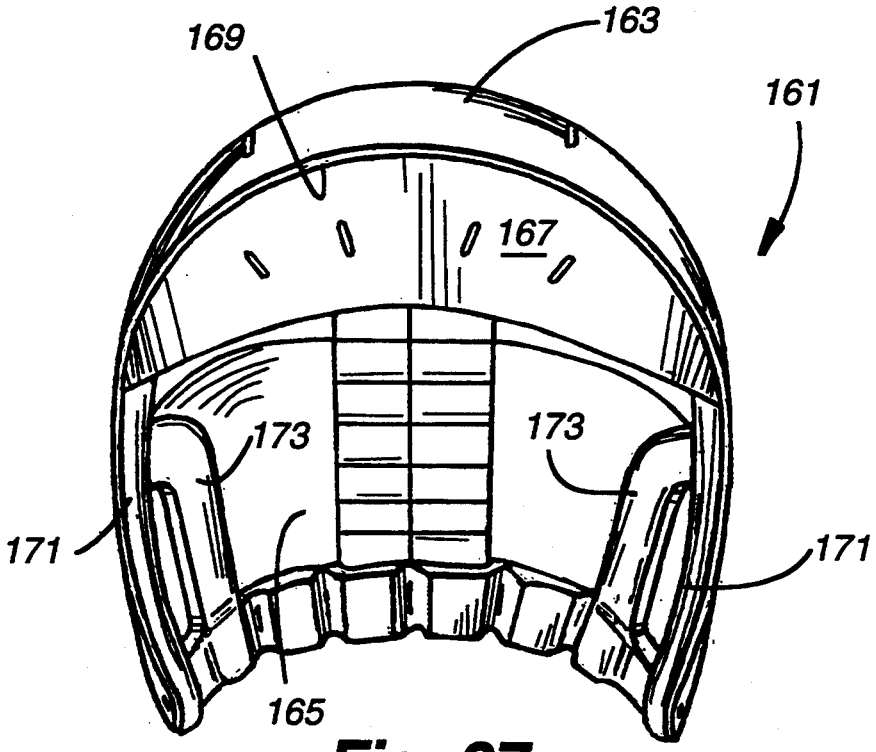
FIG. 27 is a front view of the helmet of the third embodiment.

The inner shell liner 109 is in the form of an articulated or segmented lune shaped foam pad of complementary shape to the outer shell 103 so as to completely cover the inner surface of the shell in close juxtaposition therewith. The liner is at least partially separable from the shell to facilitate washing and cleaning the pad and shell to remove sand, salt water and the like from between them. Because of the close fit of the helmet on the wearer's head, it is highly desirable that the pad not only be prevented from shifting in the helmet, but also be readily partially separable to facilitate such cleaning and washing. Accordingly, the liner is articulated into a plurality of separable but non-detachable panels which can be lifted for washing or cleaning and returned to place without shifting within the shell. As shown in FIG. 21, the liner 109 comprises a central apical panel or portion 137, a pair of anterior parietal covering panels or portions 139, a pair of rear parietal covering panels or portions 141, a leading peripheral panel or portion 143 and a rear peripheral panel or portion 145.

The central apical portion 137 of the liner is a narrow, articulated panel attached at each end along hinge lines to the inner edges of the leading peripheral panel 143 and the rear peripheral panel 145 and overlies the crest portion 119 of the inner frame and the central portion of the interior shell surface. In one preferred form the inner surface of the apical panel 137 is sectioned to define two rows of rectangular protuberances 138 which follow the apical contour of the helmet and are sized to facilitate the apical portion 137 being pressed into engagement with the confronting surface of the inner frame and shell without buckling. The apical portion 137 is discrete from the parietal covering portions 139 and 141, but is integrally joined at each end to panels or the peripheral panels or portions 143 and 145 of the liner. Accordingly, because of the apical panel's segmented character, it may be partially separated or lifted away from the inner surface of the shell without detachment from the peripheral panels to facilitate cleaning of the liner and shell.

The leading peripheral portion 143 of the liner is disposed in juxtaposition to the leading centrally arched edge 115 of the shell 103 and the inner surface of the longitudinal portion 117 of the inner frame 107, and thus follows the contour of this portion of the shell and frame 107. The opposing terminal ends of the leading peripheral portion 143 are formed with integral lobe portions 147 which are provided with a central opening 149 to accommodate the ears of a wearer of the helmet. The lobe portions 147 provide a surround for each ear which is thickened along the front **147*a* and lower rear 147*b* portions thereof to accommodate the ear comfortably within the central opening 149 therebetween, and is reduced at the bottom of the central opening 149 between the thickened front and rear portions 147*a* and 147*b* to form a drain 151**, disposed so as to communicate with the outer ear canal of the ear of the wearer and allow fluid to drain from within the confines of the central opening and the ear, out of the lobe portions.

The front portions **147*a* of the lobe panels or portions 147 of the liner are adhered directly to the inner surface of the longitudinal panel or portion 117 of the inner frame 107, while the remainder of the leading peripheral portion 143 is discrete or separable from the inner frame to enable it to be drawn away from its juxtaposition with the inner frame for access thereto without detachment from the lobe portions 147. Similarly, the bottom of the lobe portions 147** are adhered directly to the inner surface of the corresponding bottom edge of the shell.

The rear peripheral portion 145 of the liner is shallowly sectioned or recessed to define a series of spaced protrusions 153 and alternating shall sections or depressions 155 which are disposed in a row along the rear peripheral portion 145 to engage the occipital portion of the wearer's head and simultaneously to allow for fluid within the helmet to drain out between the shallow sections or channels 155 disposed between the protrusions 153. The rear peripheral portion 145 is adhered directly to the bottom rear periphery of the outer shell 103 and thus is integrally connected with the respective lower rear portions **147*b* of the lobe portions 147 of the leading peripheral portion 143. The rear peripheral portion 145 is integrally formed with the rear end of the central apical portion 137 to provide a basic framework for the liner 109**.

The front and rear parietal covering panels or portions 139 and 141 of the liner are disposed on each side of the central apical portion 137 to cover the remaining spaces of this framework. To facilitate partial separation or lifting of the parietal panels for cleaning purposes, the front parietal covering portions 139 are each integrally joined with the trailing edge of the adjacent leading peripheral portion 143, and the top of the lobe portions 147 at each side of the helmet respectively. Furthermore, they are discrete from the adjacent side of the central apical portion 137 and the leading edge of the adjacent rear parietal covering portion 141. The rear parietal covering portions 141 are integral with the remainder of the adjacent rear portions of the respective lobe portions 147 and discrete from the adjacent sides of the apical portion 137 and the trailing edges of the rear peripheral portion 145.

The purpose for the discrete separation of the various portions of the inner shell liner 109 is to facilitate the opening up and separation of the central apical portion and the parietal covering portions from their adjacent engagement with each other and their juxtaposition with the inner surface of the shell to facilitate cleaning of the helmet and removal of entrenched sand and grit, as was the case of the provision of the head retention means in the first embodiment, but without the need of actually having to remove the liner completely from the helmet. Importantly, the specific positioning and sizing of the various portions comprising the liner 109 enable the moveable portions thereof to be disposed back into engagement with the inner surface of the helmet to present a smooth and continuous inner surface for comfortably accommodating the head of a wearer.

The front band 111 is substantially similar to that of the preceding embodiment, except instead of being adjustable and removable from the helmet, it is fixedly adhered to the inner surface of the longitudinal portion 117 of the inner framed 107. The front band 111 is disposed so as to tautly span across the open face of the helmet defined by the centrally arched portion 115 to cover the forehead of a wearer. The lower periphery 157 of the front band 111 is hemmed to form a smooth edge and is slightly curved concavely to bridge across the forehead of the wearer without impairing the wearer's vision.

The proximal end of the front band 111 is not adhered to the outer engaging surface of the leading peripheral portion 143 of the liner 109, so that the top part of the leading peripheral portion can be pulled away from its normal biased engagement with the proximal end of the front band to facilitate the cleaning and separation of the other portions of the liner as previously described.

The chin strap 113 is of simpler design to the chin strap described in the preceding embodiment having the respective ends thereof respectively affixed by means of the pins 127 to the inside of the terminal ends 117*a* of the inner frame 107. Accordingly, the lower front portions 147*a* of the respective lobe portions 147 are adhered over the ends of the chin strap to conceal the attachment thereof to the frame and helmet.

As can be seen, the helmet arrangement of the second embodiment is substantially similar to the first embodiment, effectively constituting a refinement of the same to facilitate manufacture of the helmet in accordance with the invention.

The third embodiment, is substantially identical to the second embodiment, except that it dispenses with the visor arrangement completely, and consequently is modified in construction, eliminating the requirement for an inner frame, lune shaped cavity and wiper means.

Nonetheless, as shown in FIGS. 22 to 27 of the drawings, the helmet 161, maintains the provision of the outer shell 163, the inner shell liner 165, the front band 167 and the chin strap (not shown) of the second embodiment and so is substantially similar in appearance and function, apart from the provision of the visor, to the helmet of the second embodiment. Consequently, the front band 167 is directly adhered to the inner side of the centrally arched portion 169 of the outer shell 163 and the front portions 171 of the lobe portions 173 are directly adhered to the corresponding periphery of the inner surface of the outer shell 163.

It should be appreciated that the scope of the present invention is not limited to the particular embodiment herein described. In particular, the material from which the various components of the helmet are formed can be altered to suit the particular application undertaken or changed in accordance with conventional design techniques.

I claim:

1. A high performance sport safety helmet comprising, in combination, a shell adapted for fitting upon a wearer's head and having a frontal periphery defining a centrally arched portion forming an open front exposing the face and a major portion of the forehead of the wearer, a flexible resilient expandable front band extending across the front of said shell with substantially all of said band lying below said centrally arched portion, said front band having an upper convex outline coextensive with the periphery of the centrally arched portion of said shell and adapted for snugly engaging and substantially completely covering the forehead of the wearer independently of the shell, and means securing said band within the confines of said shell, whereby the head and forehead of the wearer are covered and protected against direct impact by a foreign object.

2. A safety helmet as defined in claim 1, wherein said securing means mounting said band within the confines of said shell comprises adjustable strap means connected to said band for adjustment of said band relative to the forehead of the wearer.

3. A safety helmet as defined in claim 1, further including means defining a series of ventilation holes in said band.

4. A sport safety helmet as defined in claim 1, wherein a single, substantially lune-shaped visor is pivotally mounted to said shell and moveable between a closed position, an open position, and any intermediate position therebetween, said pivotal mounting comprising a pair of pivot pins located in opposed apertures at a base portion of said shell and the narrow end of said lune-shaped visor.

5. A safety helmet as defined in claim 4, wherein said visor defines a leading edge being slightly sculptured inwardly of the general locus of curvature thereof proximate to said leading edge so that in said open position said leading edge presents a closed face mitigating drag through air or water impinging on the front of said helmet.

6. A safety helmet as defined in claim 4, wherein in said closed position, said visor substantially closes said open front maintaining the general curvature of said shell to substantially cover the face of said wearer providing protection from impact and shading from the sun without impairing vision.

7. A safety helmet as defined in claim 5, wherein in said closed position, said leading edge of said visor is generally aligned with the bottom of the nose of the wearer.

8. A safety helmet as defined in claim 5 wherein in said open position the major portion of said visor is disposed within said shell and conforms to the contour of said shell to expose the face of said wearer without interfering with the fitting of said shell upon said wearer's head and the minor exposed portion of said visor comprising said leading edge is contiguous to said shell while maintaining the general curvature of said shell.

9. A safety helmet as defined in claim 5, wherein the curvature of said visor adjacent said leading edge provides minimal disruption to the line of sight of said wearer so that said visor can be used in an intermediate position.

10. A safety helmet as defined in claim 4, including retaining means for retaining said visor at any intermediate position between said open and said closed positions comprises a wiper fixedly mounted to said shell and having a wiper pad frictionally engaging the external surface of said visor, whereby during movement of said visor between said open position and said closed position said wiper pad wipes across said visor surface to clean the same while preventing the retention of foreign particles which otherwise would scratch the surfaces of said visor.

11. A safety helmet as defined in claim 10, wherein said shell includes an inner frame mounted therein to define a lune shaped cavity across said helmet to accommodate said visor when in the open position and permit movement of said visor along said cavity to the closed position.

12. A safety helmet as defined in claim 11, wherein said retaining means comprises a further wiper pad fixedly mounted to said inner frame directly opposite and in parallel relationship to said wiper pad to define a space between said pads for allowing the passage of said visor and whereby the further wiper pad engages the internal surface of said visor.

13. A safety helmet as defined in claim 1, including an inner shell liner comprising leading and rear peripheral portions disposed along the inner periphery of the helmet, a central apical portion disposed centrally of the inner surface of the helmet between said leading and rear peripheral portions, and front and rear parietal portions disposed between said leading and rear peripheral portions and said central apical portion over the remaining inner surface of the helmet, so that said shell liner completely covers the cranium of a wearer, and wherein some of the portions of the liner are discrete from other portions of the liner to enable access to the inner surface of the helmet for cleaning purposes.

14. A safety helmet as defined in claim 13, wherein the bottom peripheral portions of said inner shell liner are contoured to facilitate the draining of fluid from with the helmet.

15. A safety helmet as defined in claim 13, wherein said leading peripheral portion comprises a lobe portion at each side of the helmet formed with a central opening for accommodating the ears of wearer, the bottom of the lobe portion having a drain connecting to said central opening for communicating with the base of the outer ear canal of a wearer of the helmet so as to be capable of draining fluid from said ear canal and said central opening.

16. A safety helmet as defined in claim 1, wherein the sides of the helmet cover the sides of the face of a wearer to prevent wind entering the ear canal of the wearer.

17. A safety helmet as defined in claim 1, wherein said centrally arched portion is formed with a high cut over the forehead portion of said wearer and is rearwardly swept at the sides of the helmet to enable complete peripheral vision.

18. A high performance sport safety helmet comprising, in combination, a shell adapted for fitting upon a wearer's head and having a frontal periphery defining a centrally arched portion forming an open front exposing the face and a major portion of the forehead of the wearer, a flexible resilient hood for covering the wearer's head, means for releasably securing said hood within said shell, said hood including a flexible resilient front band extending across said centrally arched portion of said shell and substantially all of said band lying below said centrally arched portion and adapted for engaging and covering the forehead of the wearer independently of said shell, said front band having an upper convex outline coextensive with the periphery of the centrally arched portion of said shell, and means releasably securing said band to said hood, whereby the head and forehead of the wearer are covered and protected against direct impact by a foreign object.

19. A high performance sport safety helmet comprising, in combination, a shell adapted for fitting upon a wearer's head and having a frontal periphery defining a centrally arched portion forming an open front exposing the face and a major portion of the forehead of the wearer, a flexible resilient expandable front band extending across the front of said shell with substantially all of said band lying below said centrally arched portion and adapted for snugly engaging and substantially completely covering the forehead of the wearer independently of said shell, said front band having an upper convex outline coextensive with the periphery of the centrally arched portion of said shell, and means securing said band to said shell, whereby the head and forehead of the wearer are covered and protected against direct impact by a foreign object.

20. A high performance sport safety helmet comprising, in combination, a shell adapted for fitting upon a wearer's head and having a frontal periphery defining a centrally arched portion forming an open front exposing the face and a major portion of the forehead of the wearer, a flexible resilient hood for covering the wearer's head, means for releasably securing said hood within said shell, said hood including a flexible resilient front band extending across said centrally arched portion of said shell and substantially all of said band lying below said centrally arched portion and adapted for engaging and covering the forehead of the wearer independently of said shell, said front band having an upper convex outline coextensive with the periphery of the centrally arched portion of said shell, and means releasably securing said band to said shell, whereby the head and forehead of the wearer are covered and protected against direct impact by a foreign object.

21. A high performance sport safety helmet comprising: a substantially rigid shell for fitting upon a wearer's head and having an open front to expose the face and a major portion of the forehead of the wearer; a single, substantially lune-shaped visor pivotally mounted to said shell by a pair of pivot pins located in opposed apertures at a base portion of said shell and the narrow end of said lune-shaped visor and moveable between a closed position, an open position, and any intermediate position therebetween, said visor defining a leading edge and being slightly sculptured inwardly of the general locus of curvature thereof proximate to said leading edge so that in said open position, said leading edge presents a closed face mitigating drag through air or water impinging on the front of said helmet, and means for retaining said visor at any intermediate position between said open and said closed positions, (i) in said closed position, said visor substantially closes said open front maintaining the general curvature of said shell to substantially cover the face of said wearer providing protection from impact and shading from the sun without impairing vision, and said leading edge of said visor is generally aligned with the bottom of the nose of the wearer, (ii) in said open position, the major portion of said visor is disposed within said shell and conforms to the contour of said shell to expose the face of said wearer without interfering with the fitting of said shell upon said wearer's head and the minor exposed portion of said visor comprising said leading edge is contiguous to said shell while maintaining the general curvature of said shell, and (iii) the curvature of said visor adjacent said leading edge provides minimal disruption to the line of sight of said wearer so that said visor can be used in an intermediate position.

22. A safety helmet as defined in claim 21, wherein said retaining means comprises a wiper fixedly mounted to said shell and having a wiper blade frictionally engaging the surface of said visor, whereby during movement of said visor between said open position and said closed position said wiper blade wipes across said visor surface to clean the same while preventing the retention of foreign particles which otherwise would scratch the surfaces of said visor.

23. A safety helmet as defined in claim 21, wherein said shell includes an inner frame mounted therein to define a lune shaped cavity across said helmet to accommodate said visor when in the open position and permit movement of said visor along said cavity to the closed position.

24. A safety helmet as defined in claim 23, wherein said wiper means comprises two halves, each provided with a discrete blade, one half fixedly mounted to said shell proximate the periphery of said open front to engage the external surface of said visor, and the other half fixedly mounted to said inner frame directly opposite and in parallel relationship to said one half to define a space between said halves and for the blade of the other half to engage the internal surface of said visor.

25. A safety helmet as defined claim 21, including resilient head retention means comprising a top cover for covering the parietal and temporal portion of the wearer's cranium, a back support for covering the occipital portion of the wearer's cranium, and a pair of side covers for covering the ears and the temporal portion of the wearer's cranium, said side covers each defining a pouch to accommodate the ears of said wearer, each said pouch having a drain disposed in the region of the pouch communicating with the base of the outer ear canal of the wearer so as to be capable of draining liquid from said ear canal and said region.

26. A safety helmet as defined in claim 25, wherein said side covers cover the sides of the face to prevent wind entering the ear canal of the wearer.

27. A safety helmet as defined in claim 25, wherein said side covers are fixedly attached to said shell and inner frame.

28. A safety helmet as defined in claim 25, wherein said top cover is substantially lune shaped and is provided with a series of holes for ventilation purposes.

29. A safety helmet as defined in claim 25, wherein said back support is shaped to provide openings for ventilation.

30. A safety helmet as defined in claim 21, comprising a resilient front band for covering the frontal portion of the wearer's cranium, said front band being fitted to said shell to provide for adjustment thereof relative to the head of the wearer.

31. A safety helmet as defined in claim 30, wherein said band is provided with a series of holes for ventilation.

32. A safety helmet as defined in claim 21, wherein said shell is provided with a series of apertures for ventilation of the wearer's head.

33. A high performance sport safety helmet comprising, in combination, a shell adapted for fitting upon a wearer's hand and having a frontal periphery defining a centrally arched portion forming a front opening exposing the face and a major portion of the forehead of the wearer and a base periphery defining an arcuate base opening for receiving the wearer's neck, a flexible resilient expandable front band secured to and extending across the front opening of said shell with substantially all of said band lying below said centrally arched portion and adapted for snugly engaging and substantially completely covering the exposed forehead of the wearer independently of said shell, and an articulated shell liner secured to and covering the inner surface of said shell in partially separable non-detachable relation therewith.

34. A high performance sport safety helmet comprising, in combination, a shell adapted for fitting upon a wearer's head and having a frontal periphery defining a centrally arched portion forming a front opening exposing the face and a major portion of the forehead of the wearer and a base periphery defining an arcuate base opening for receiving the wearer's neck, a flexible resilient expandable front band secured to and extending across the front opening of said shell with substantially all of said band lying below said centrally arched portion and adapted for snugly engaging and substantially completely covering the forehead of the wearer, an articulated shell liner secured to and covering the inner surface of said shell in partially separable non-detachable relation therewith, and a visor pivotally secured to said shell by a pair of pivot pins located in opposed apertures at a lower base portion of said shell and said visor and nestable between said shell and said shell liner for selectively shielding the front opening of said shell.

35. A high performance sport safety helmet comprising, in combination, a shell adapted for fitting upon a wearer's head and having a frontal periphery defining a centrally arched portion forming a front opening exposing the face and a major portion of the forehead of the wearer and a base periphery defining an arcuate base opening for receiving the wearer's neck, a flexible resilient expandable front band secured to and extending across the front opening of said shell with substantially all of said band lying below said centrally arched portion and adapted for snugly engaging and substantially completely covering the forehead of the wearer, an articulated shell liner secured to and covering the inner surface of said shell in partially separable non-detachable relation therewith, a lune-shaped bracket secured within said shell in spaced relation therewith and defining a lune-shaped channel between said shell and said shell liner opening adjacent the frontal periphery of said shell, and a lune-shaped visor slidably received in said channel and pivotally secured to said shell by a pair of pivot pins located in opposed apertures at a lower base portion of said shell and the narrow end of said lune-shaped visor for extension from said shell to shield the face of a wearer and nestable into said channel for exposing the face of the wearer.

36. A high performance sport safety helmet comprising, in combination, a shell adapted for fitting upon a wearer's head and having a frontal periphery defining a centrally arched portion forming a front opening exposing the face and a major portion of the forehead of the wearer and a base periphery defining an arcuate base opening for receiving the wearer's neck, a flexible resilient expandable front band secured to and extending across the front opening of said shell with substantially all of said band lying below said centrally arched portion and adapted for snugly engaging and substantially completely covering the forehead of the wearer, and an articulated shell liner covering the inner surface of said shell, said liner having a leading peripheral panel disposed in juxtaposition to the centrally arched portion of said shell, lobe panels integral with said leading peripheral panel at its terminal ends and defining openings for surroundingly receiving the wearer's ears, said lobe panels being partially secured to said shell adjacent the centrally arched portion and peripheral base edge thereof, the portion of said lobe panels adjacent said base edge being of reduced thickness, a rear peripheral panel joined at each end to said lobe panels and secured to said shell adjacent the base edge thereof, said rear peripheral panel having spaced inwardly directed projections thereon defining intermediate channels, a central elongated panel formed of integrally joined segments and extending between and joined to said leading and rear panels, front panels covering the front portion of the spaces between said central panel and said lobe panels and each joined to a corresponding adjoining lobe panel and adjoining leading peripheral panel, and rear panels covering the rear portion of the space between said central panel and said lobe panels and each joined to a corresponding adjoining lobe panel and adjoining rear peripheral panel, whereby said shell liner can be partially separated from said shell without complete removal therefrom for cleaning said shell and liner.

37. A safety helmet as defined in claim 36 further comprising a visor pivotally secured to said shell by a pair of pivot pins located in opposed apertures at a lower base portion of said shell and said visor and nestable between said shell and said shell liner for selectively shielding the front opening of said shell.

38. A safety helmet as defined in claim 36 further comprising a lune-shaped bracket secured within said shell in spaced relation therewith and defining a lune-shaped channel between said shell and said shell liner opening adjacent the frontal periphery of said shell, and a lune-shaped visor slidably received in said channel and pivotally secured to said shell by a pair of pivot pins located in opposed apertures at a base portion of said shell and the narrow end of said lune-shaped visor for extension from said shell to shield the face of a wearer and nestable into said channel for exposing the face of the wearer.

* * * * *